United States Patent [19]

Luce

[11] Patent Number: 4,463,647

[45] Date of Patent: Aug. 7, 1984

[54] MUSICAL INSTRUMENT

[75] Inventor: David A. Luce, Clarence Center, N.Y.

[73] Assignee: Melville Clark, Jr., Wayland, Mass.

[21] Appl. No.: 420,488

[22] Filed: Sep. 23, 1982

Related U.S. Application Data

[63] Continuation of Ser. No. 714,527, Aug. 16, 1976, abandoned.

[51] Int. Cl.[3] ..... G10H 1/00

[52] U.S. Cl. ..... 84/1.01; 84/1.24; 84/1.19; 84/DIG. 7

[58] Field of Search ..... 84/1.01, 1.19, 1.03, 84/1.24, 1.25, 1.26, DIG. 7

[56] References Cited

U.S. PATENT DOCUMENTS

| | | | |
|---|---|---|---|
| 3,743,755 | 7/1973 | Watson | 84/1.03 X |
| 3,844,379 | 10/1974 | Tomisawa et al. | 84/1.26 X |
| 3,854,365 | 12/1974 | Tomisawa et al. | 84/1.03 X |
| 3,882,751 | 5/1975 | Tomisawa et al. | 84/1.26 X |
| 3,969,969 | 7/1976 | Clark, Jr. et al. | 84/1.11 X |
| 3,981,217 | 9/1976 | Oya | 84/1.03 |
| 3,986,423 | 10/1976 | Rossum | 84/1.03 |
| 4,028,978 | 6/1977 | Luce | 84/1.01 |

*Primary Examiner*—Forester W. Isen
*Attorney, Agent, or Firm*—Charles Hieken

[57] ABSTRACT

Clavier multiplexing is used in the present keyboard musical instrument to reduce the number of sound generators needed by connecting them only to those notes that are depressed. The association of a tone generator with a control unit, which provides the tone generator with frequency, force, and speed information, continues as long as possible, and even after the associated note is released and until the control unit is needed to attend another note by use of independent address and idle-busy storage registers. The note address is digitally designated and remembered, sequential start up logic is used for a control unit. In the glissando mode, the address of the note of the pair involved in the glissando that was released last must be remembered, and the voltage-controlled oscillator involved must have continuing access to this address. A fixed priority rule for nonpercussive timbres and age-dependent rule for percussive timbres is used to select control units, thus enabling multiple glissandos and the control of different tone colors from the same clavier, the latter employing additionally suppression switches. The lockouts can be stacked thereby facilitating the addition of control units on a modular basis, so that any desired plurality may be achieved. Subdivision of the key interrogation interval into two parts enables the sensing of force of key depression and sidewise motion, which is used to provide vibrato, separately, capacitive keying being used in each case. A resistor in the feedback loop of the integrator of a voltage-controlled oscillator compensates for the reset time of the integrator. The digital-to-analog converter and voltage-controlled oscillators are tied together with feedback such that the frequencies of the oscillators are dependent primarily upon resistor ratios, and not power supply potentials.

52 Claims, 40 Drawing Figures

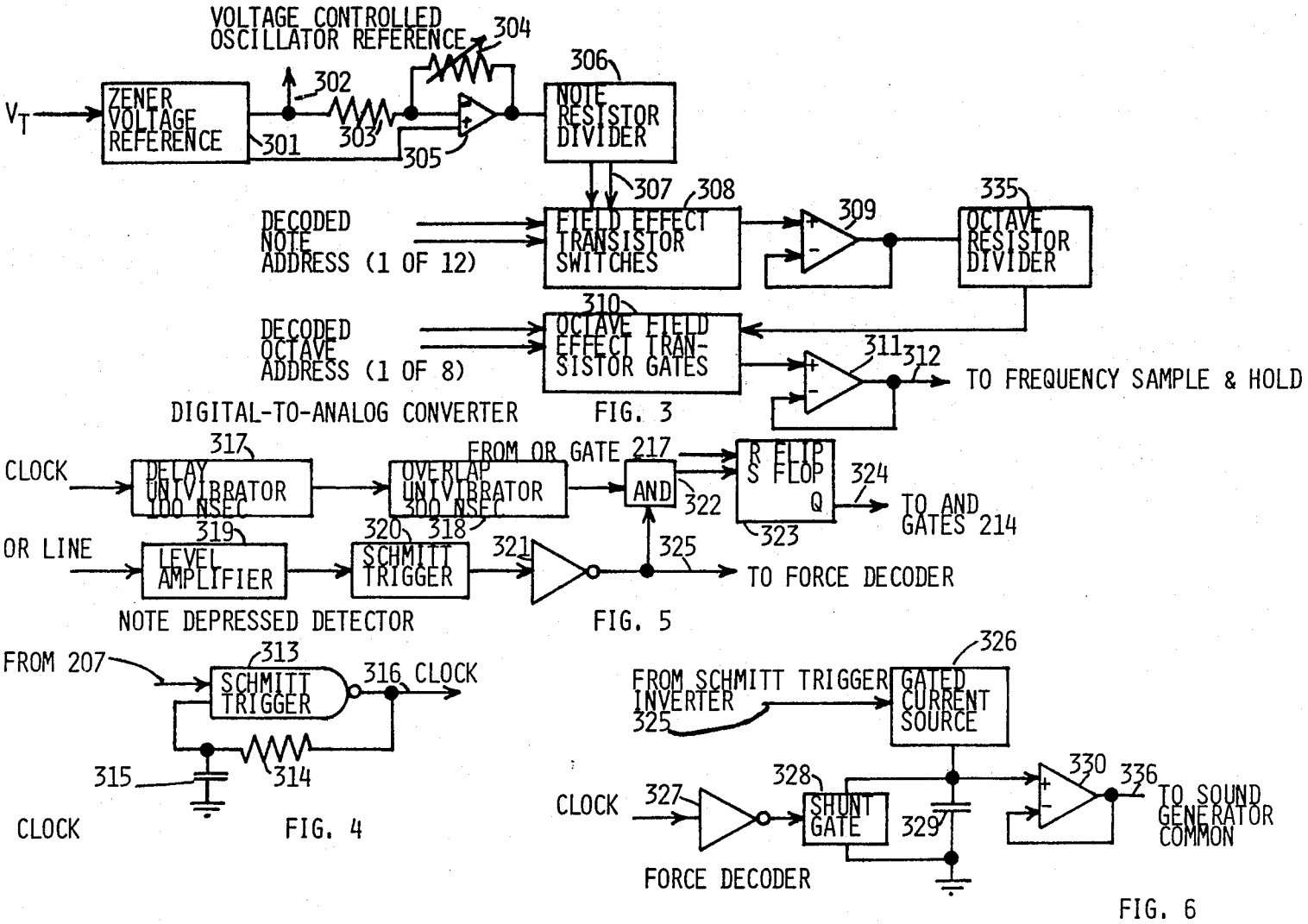
VOLTAGE CONTROLLED OSCILLATOR REFERENCE
ZENER VOLTAGE REFERENCE
$V_T$
301
302
303
304
305
NOTE RESISTOR DIVIDER
306
FIELD EFFECT TRANSISTOR SWITCHES
307
308
DECODED NOTE ADDRESS (1 OF 12)
309
OCTAVE RESISTOR DIVIDER
335
TO FREQUENCY SAMPLE & HOLD
OCTAVE FIELD EFFECT TRANSISTOR GATES
310
311
312
DECODED OCTAVE ADDRESS (1 OF 8)
FIG. 3
DIGITAL-TO-ANALOG CONVERTER
DELAY UNIVIBRATOR 100 NSEC
317
CLOCK
LEVEL AMPLIFIER
319
OR LINE
SCHMITT TRIGGER
320
OVERLAP UNIVIBRATOR 400 NSEC
318
FROM OR GATE 217
AND
322
R S FLIP FLOP
Q
323
324
TO AND GATES 214
321
TO FORCE DECODER
325
NOTE DEPRESSED DETECTOR
FIG. 5
FROM 207
SCHMITT TRIGGER
313
314
315
CLOCK
316
CLOCK
FIG. 4
FROM SCHMITT TRIGGER
325
GATED CURRENT SOURCE
326
SHUNT GATE
328
329
327
CLOCK
FORCE DECODER
330
336
TO SOUND GENERATOR COMMON
FIG. 6

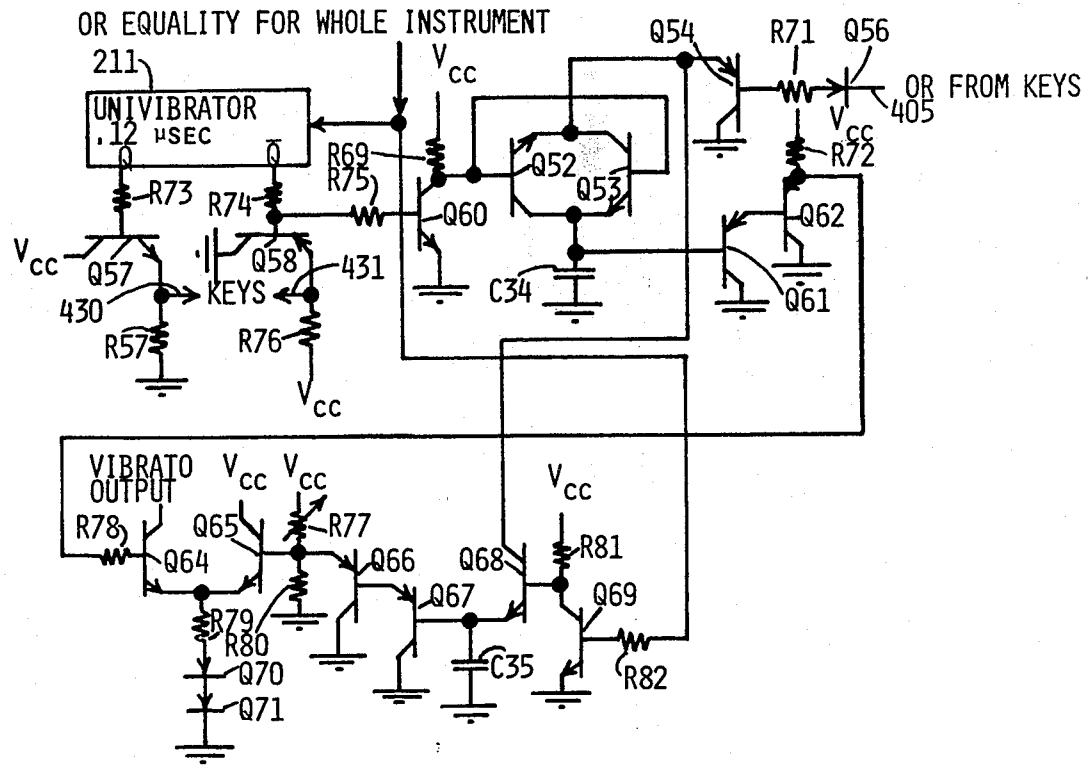
FIG. 9. VIBRATO PULSE GENERATION AND DETECTION CIRCUITRY.

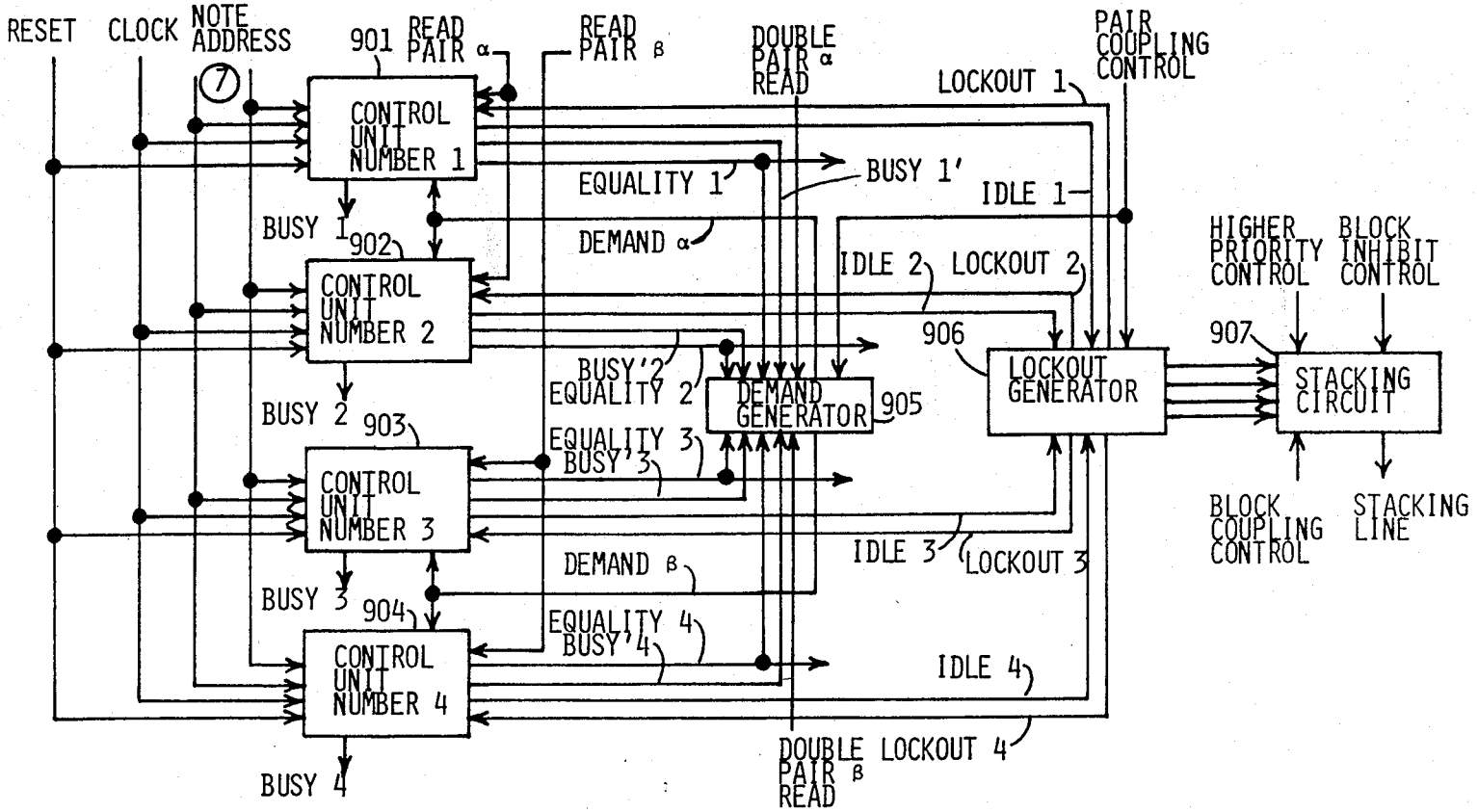
FIG. 10. SYSTEM DIAGRAM OF CONTROL UNITS.

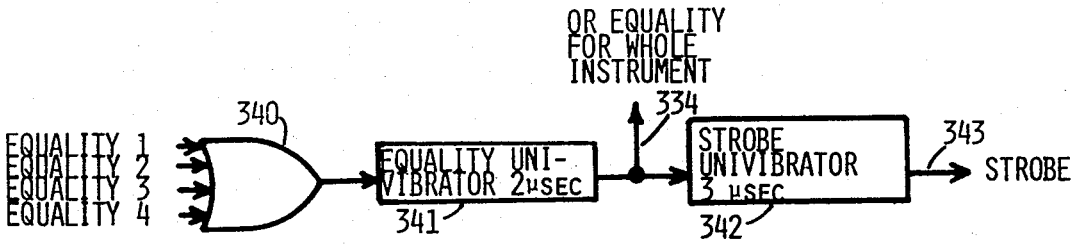
FIG. 15 STROBE & EQUALITY OR CIRCUITS
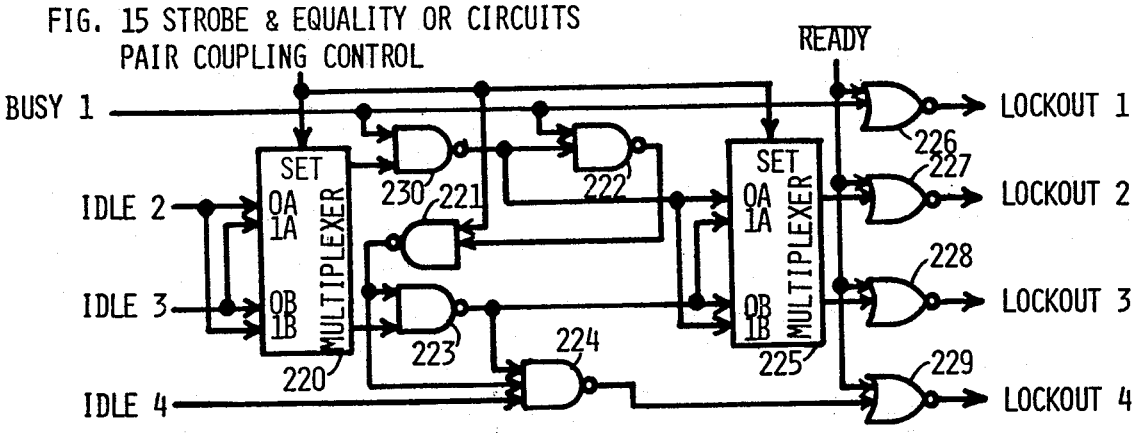
FIG. 12 LOCKOUT CIRCUITS.
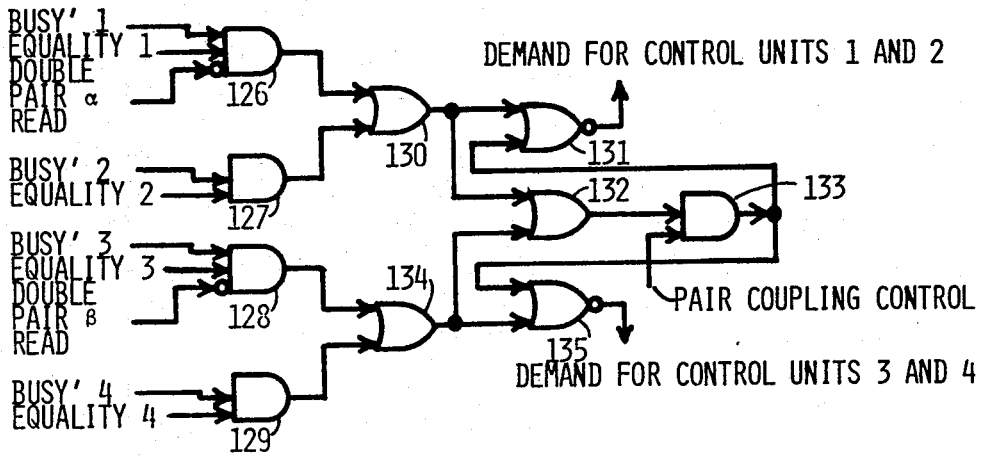
FIG. 11 DEMAND SIGNAL GENERATOR.

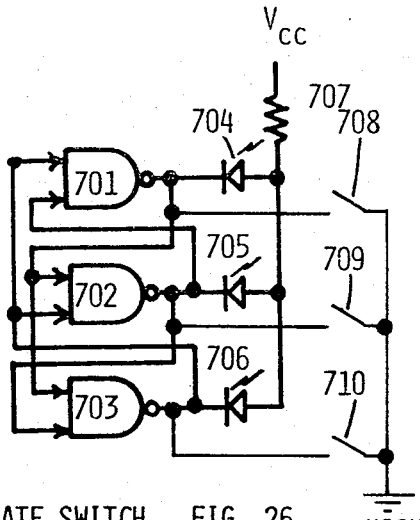
MULTISTATE SWITCH. FIG. 26.
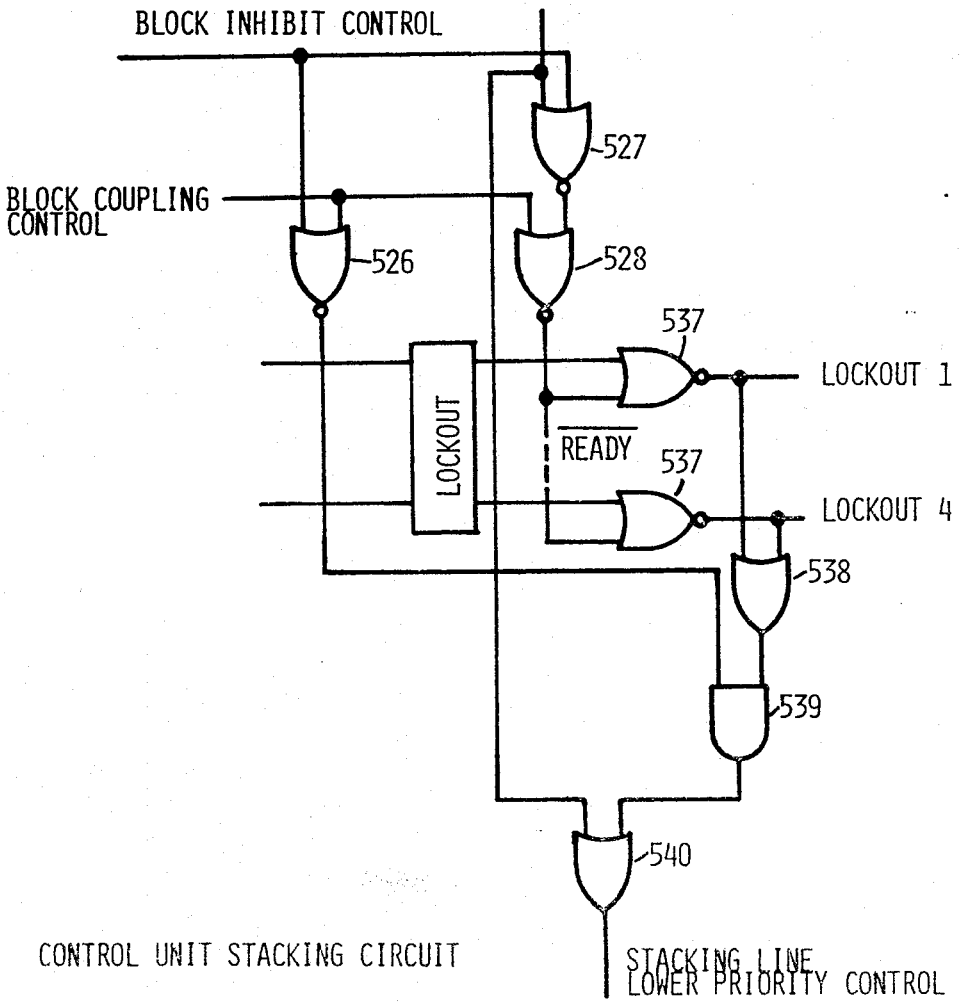
CONTROL UNIT STACKING CIRCUIT
FIG. 13.

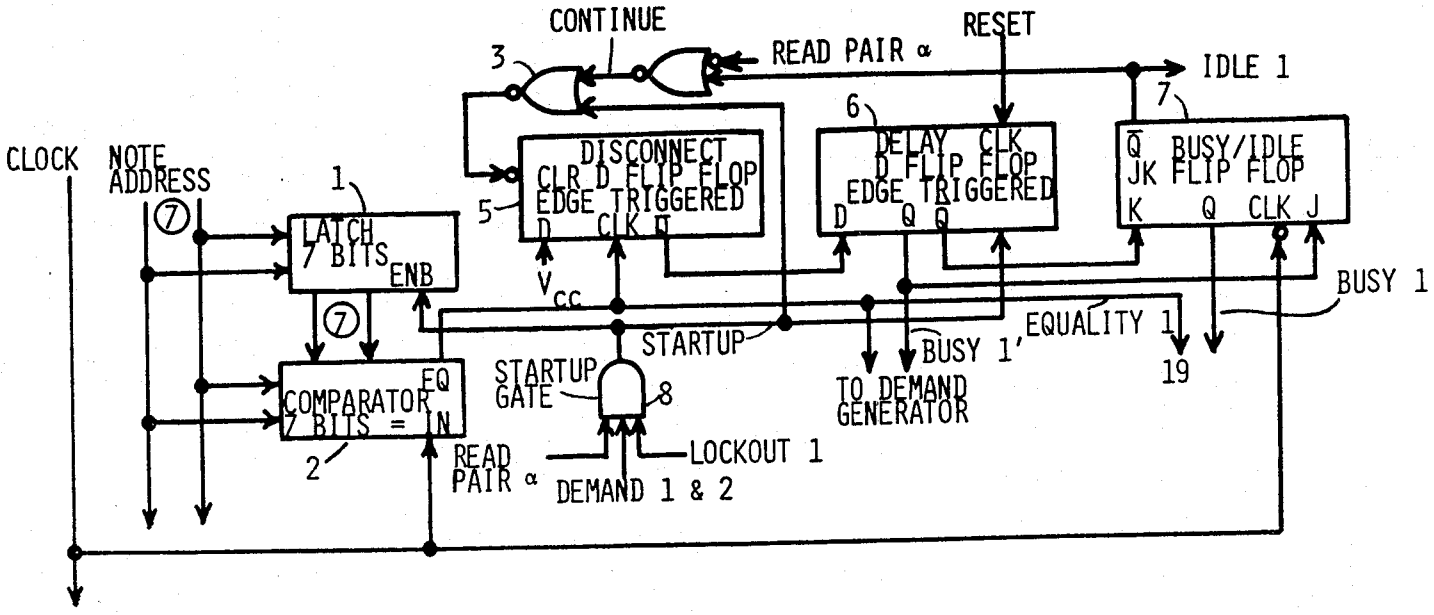
FIG. 14. CONTROL UNIT FOR ONE MEMBER OF PAIR α
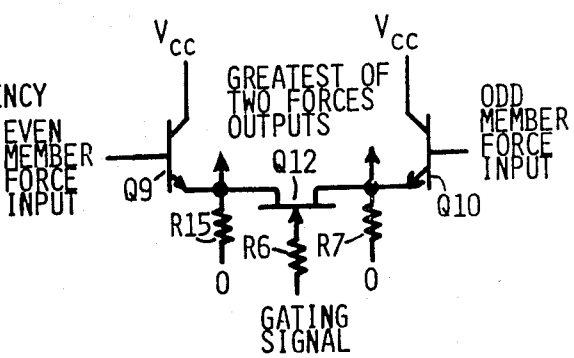
FIG. 19. GREATEST OF TWO FORCES CIRCUIT
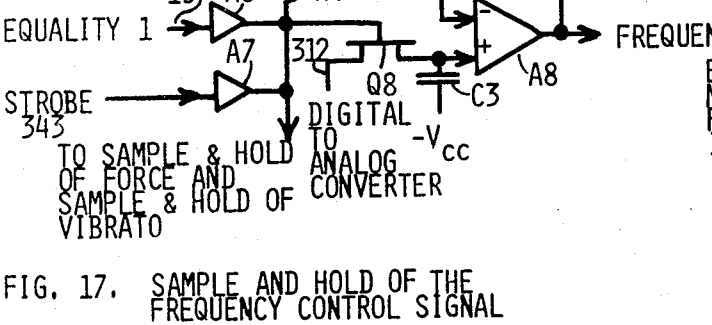
FIG. 17. SAMPLE AND HOLD OF THE FREQUENCY CONTROL SIGNAL

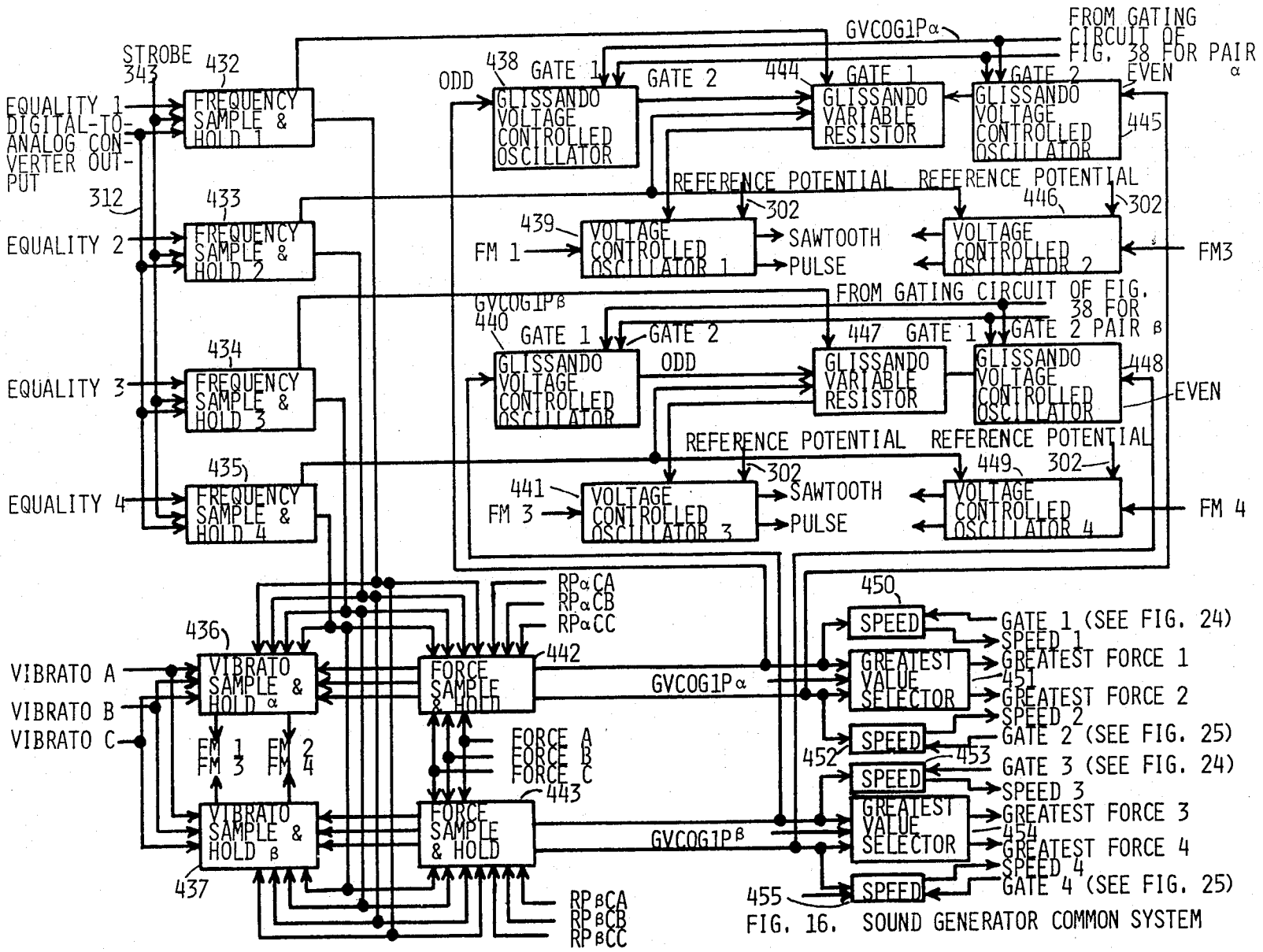
FROM GATING CIRCUIT OF FIG. 38 FOR PAIR α
EVEN
GLISSANDO VOLTAGE CONTROLLED OSCILLATOR
GATE 2
GLISSANDO VARIABLE RESISTOR
GATE 1
GVCOG1Pα
VOLTAGE CONTROLLED OSCILLATOR 2
FM3
REFERENCE POTENTIAL
SAWTOOTH
PULSE
VOLTAGE CONTROLLED OSCILLATOR 1
FM 1
FROM GATING CIRCUIT OF FIG. 38 FOR PAIR β
GVCOG1Pβ
ODD
VOLTAGE CONTROLLED OSCILLATOR 4
FM 4
VOLTAGE CONTROLLED OSCILLATOR 3
FM 3
GATE 1 (SEE FIG. 24)
SPEED 1
GREATEST FORCE 1
GREATEST FORCE 2
GATE 2 (SEE FIG. 25)
SPEED 2
GATE 3 (SEE FIG. 24)
SPEED 3
GREATEST FORCE 3
GREATEST FORCE 4
GATE 4 (SEE FIG. 25)
SPEED 4
SPEED
GREATEST VALUE SELECTOR
FORCE SAMPLE & HOLD
FORCE A
FORCE B
FORCE C
RPαCA
RPαCB
RPαCC
RPβCA
RPβCB
RPβCC
FREQUENCY SAMPLE & HOLD 1
FREQUENCY SAMPLE & HOLD 2
FREQUENCY SAMPLE & HOLD 3
FREQUENCY SAMPLE & HOLD 4
VIBRATO SAMPLE & HOLD α
VIBRATO SAMPLE & HOLD β
FM 1
FM 2
FM 3
FM 4
STROBE
EQUALITY 1 DIGITAL-TO-ANALOG CONVERTER OUTPUT
EQUALITY 2
EQUALITY 3
EQUALITY 4
VIBRATO A
VIBRATO B
VIBRATO C
FIG. 16. SOUND GENERATOR COMMON SYSTEM

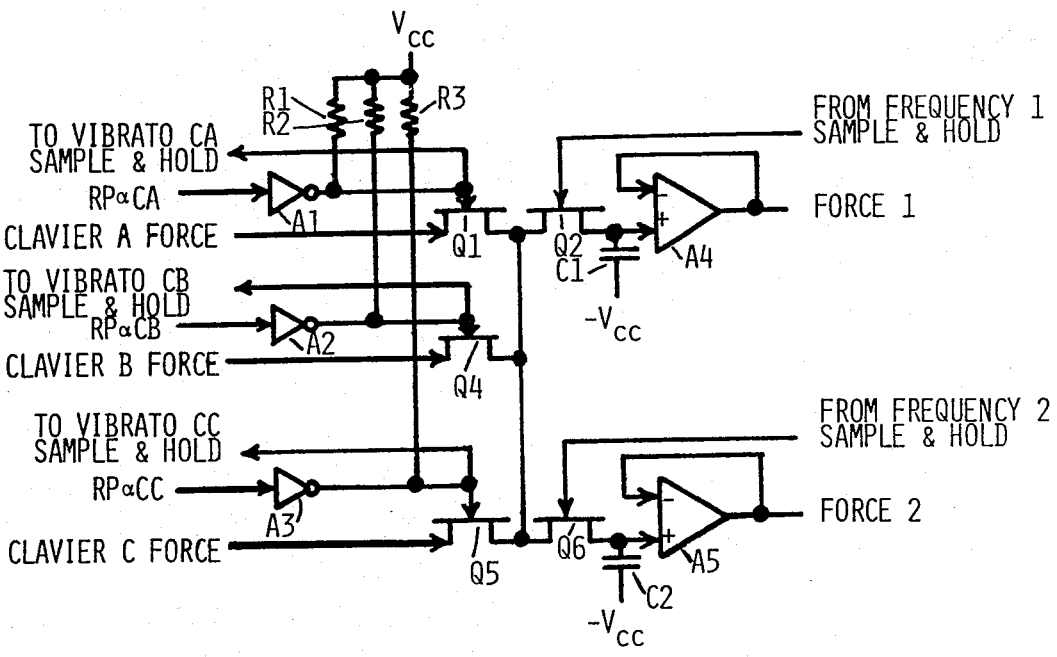
FIG. 18. SAMPLE AND HOLD OF FORCE FOR PAIR α.

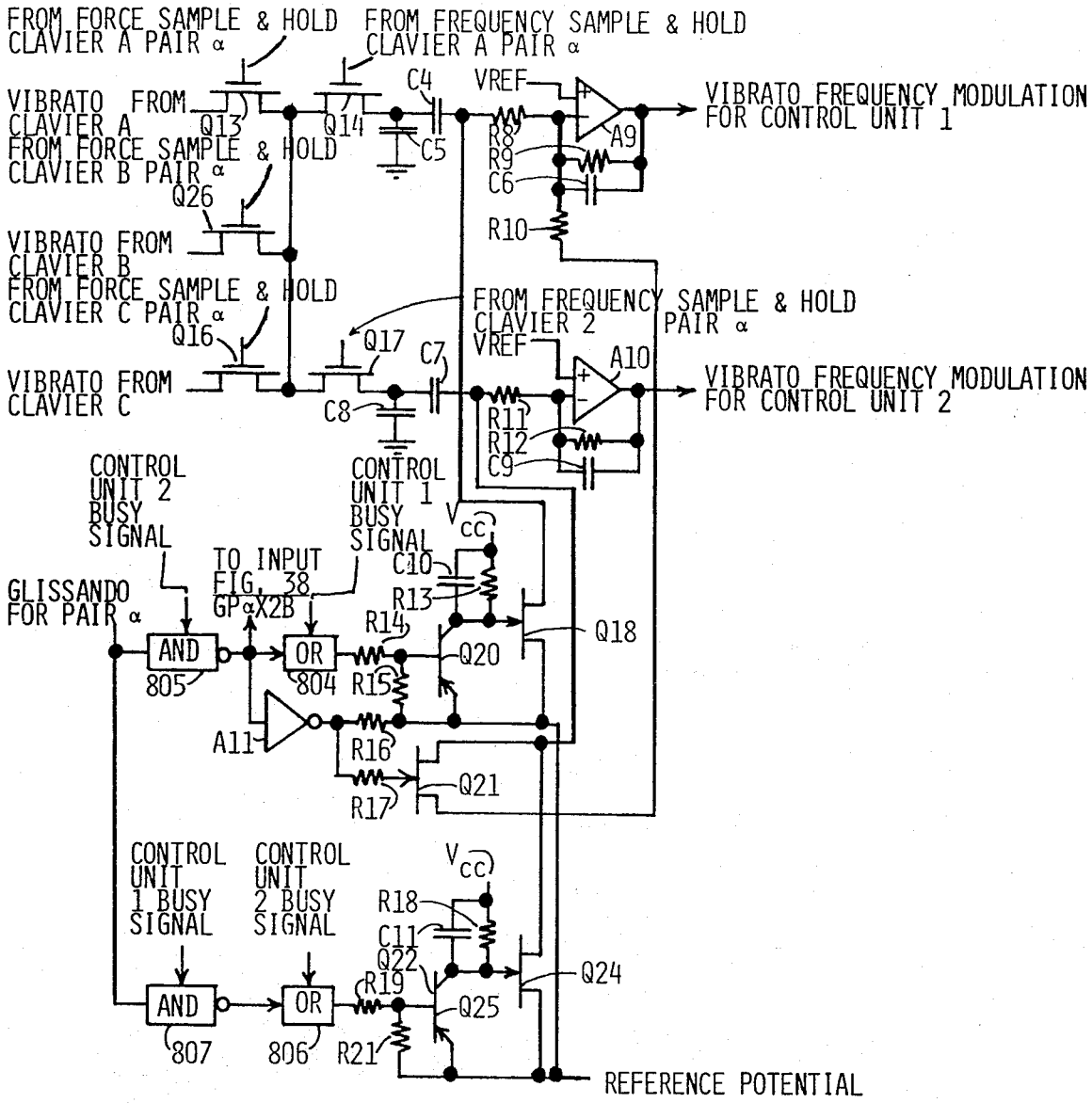
FIG. 20 VIBRATO SAMPLE AND HOLD FOR PAIR α, INCLUDING TRANSFER FROM SECOND MEMBER TO FIRST MEMBER IN GLISSANDO MODE.

GATING SIGNALS FOR GLISSANDO VOLTAGE CONTROLLED OSCILLATORS OF PAIR α AND FOR GREATEST FORCE CIRCUIT FOR THIS PAIR.

FORCE CONTROLLED OSCILLATOR FOR GLISSANDO.

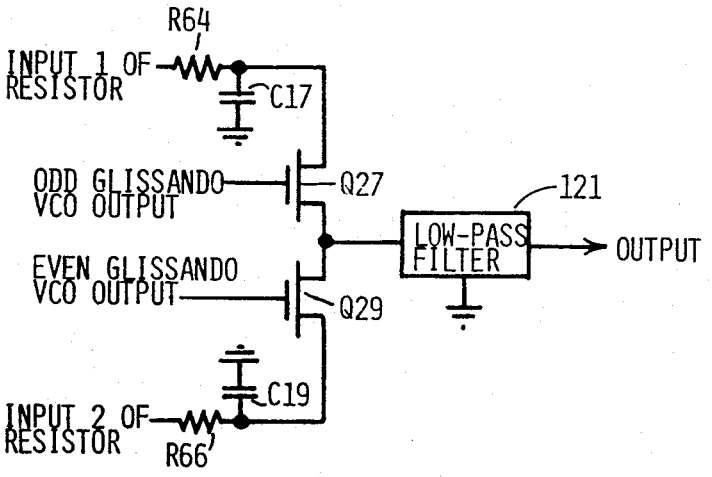
DUTY CYCLE CONTROLLED RESISTANCE BRIDGE. FIG. 22
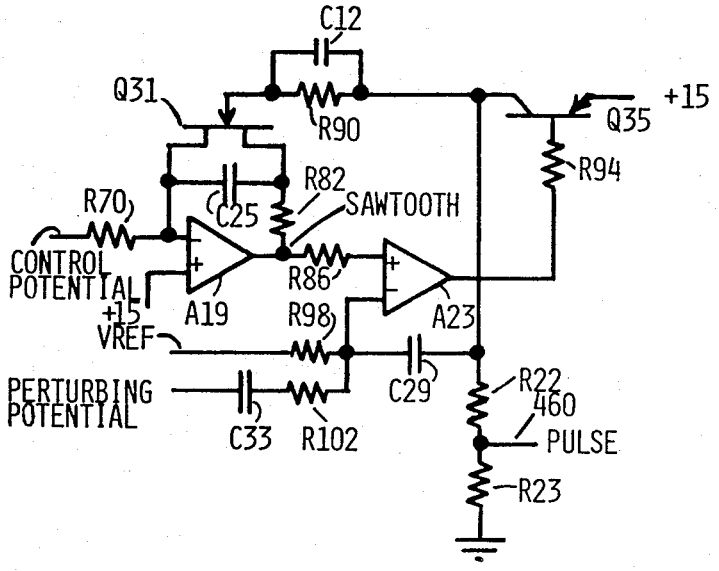
VOLTAGE CONTROLLED OSCILLATOR. FIG. 23.

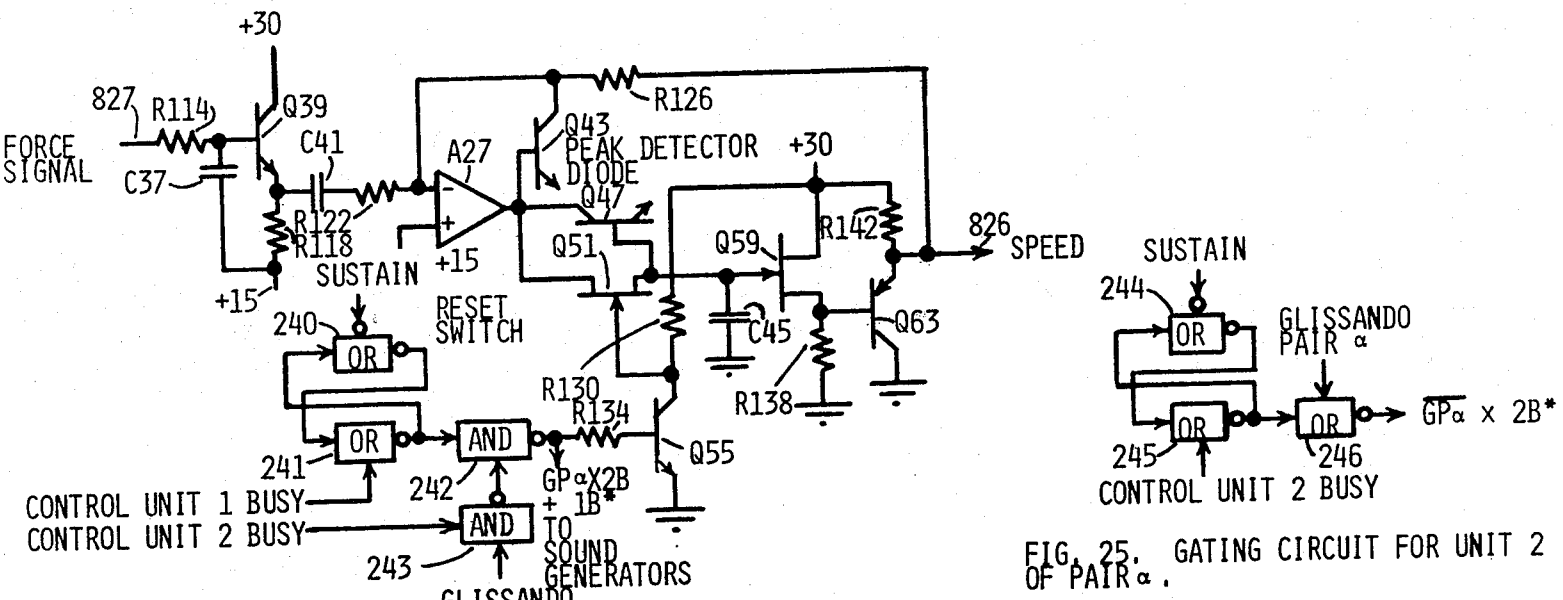
PEAK FORCE DERIVATIVE CIRCUIT FIG. 24
FIG. 25. GATING CIRCUIT FOR UNIT 2 OF PAIR α.

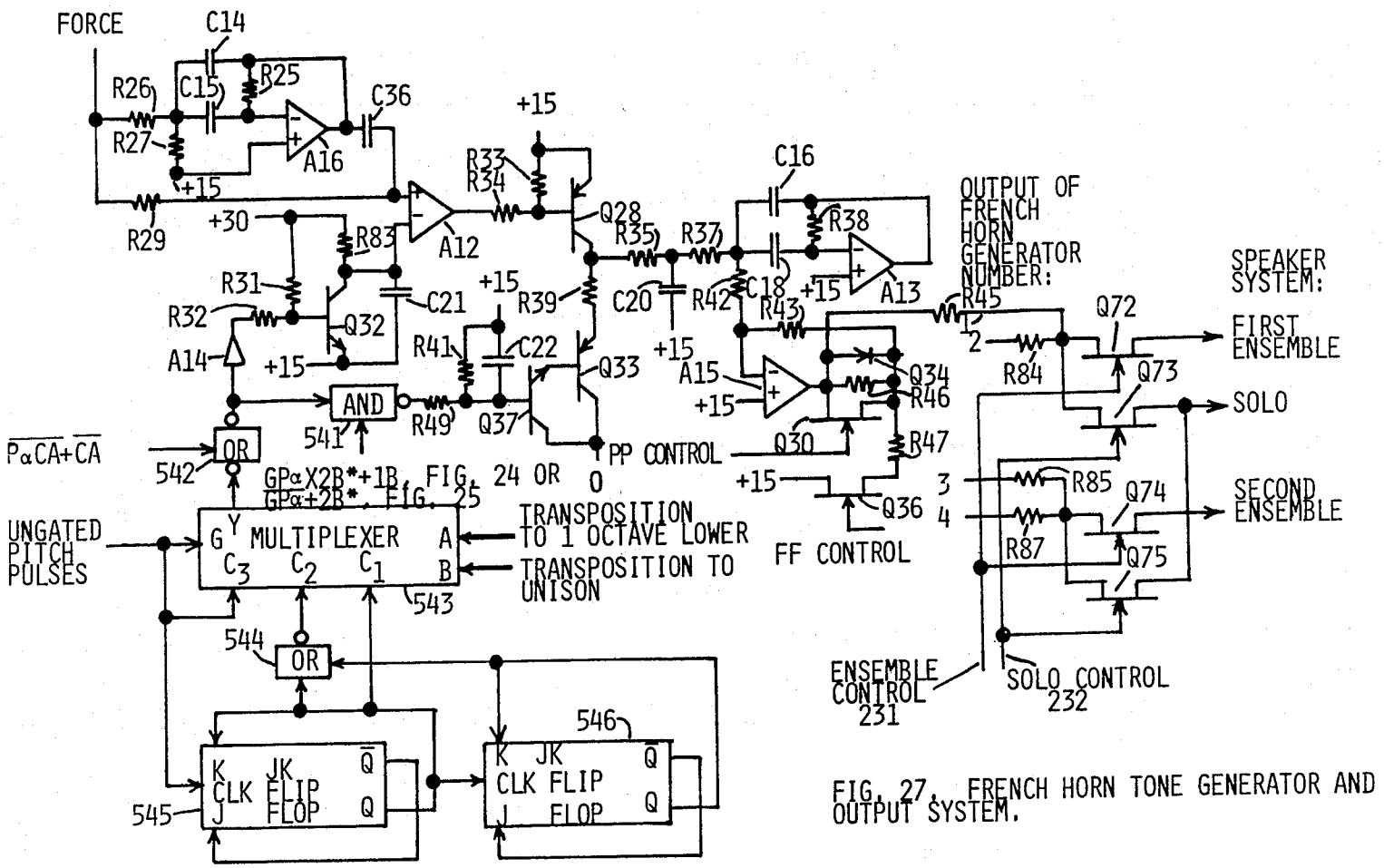
FIG. 27 FRENCH HORN TONE GENERATOR AND OUTPUT SYSTEM.

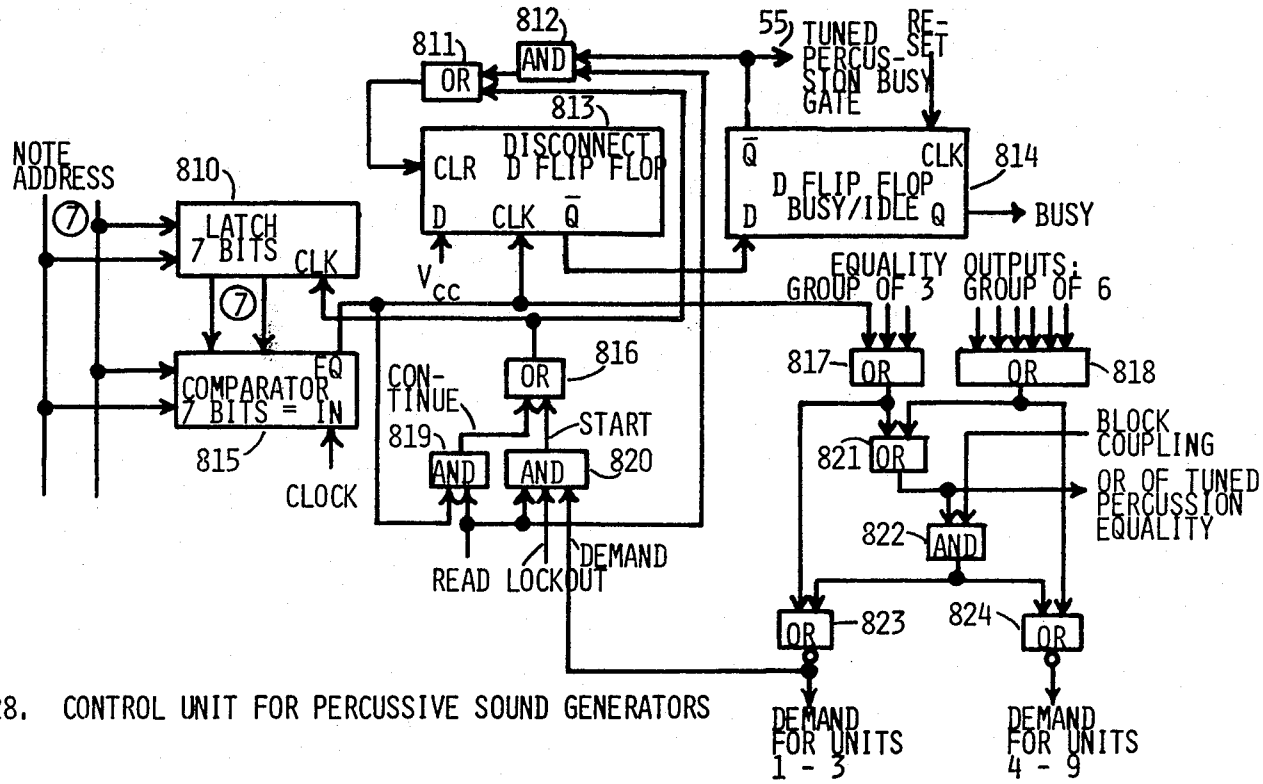
FIG. 28. CONTROL UNIT FOR PERCUSSIVE SOUND GENERATORS

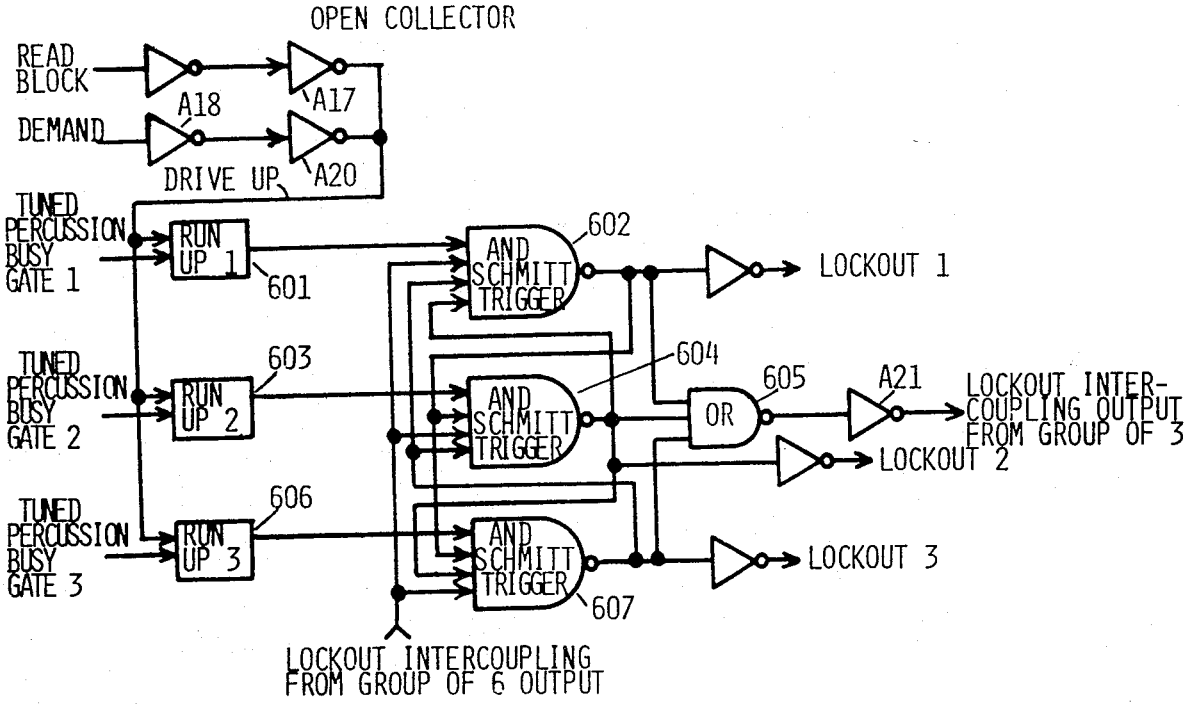
FIG. 30. LOCKOUT LOGIC FOR TUNED PERCUSSION.
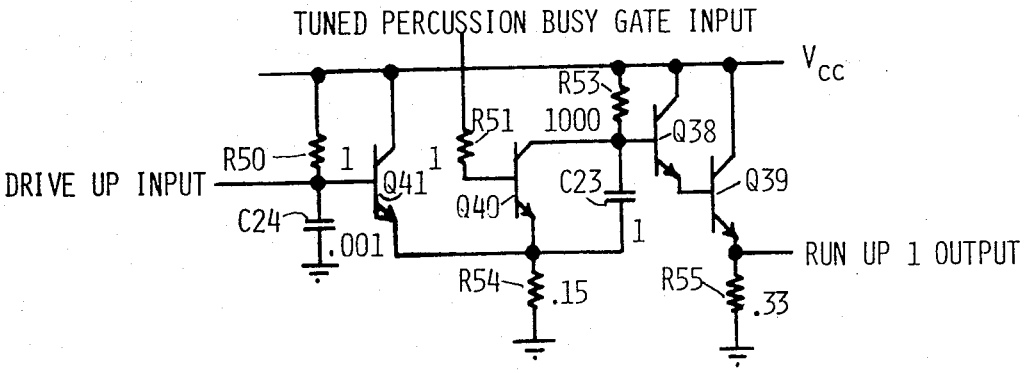
FIG. 29. RUN UP CIRCUIT.

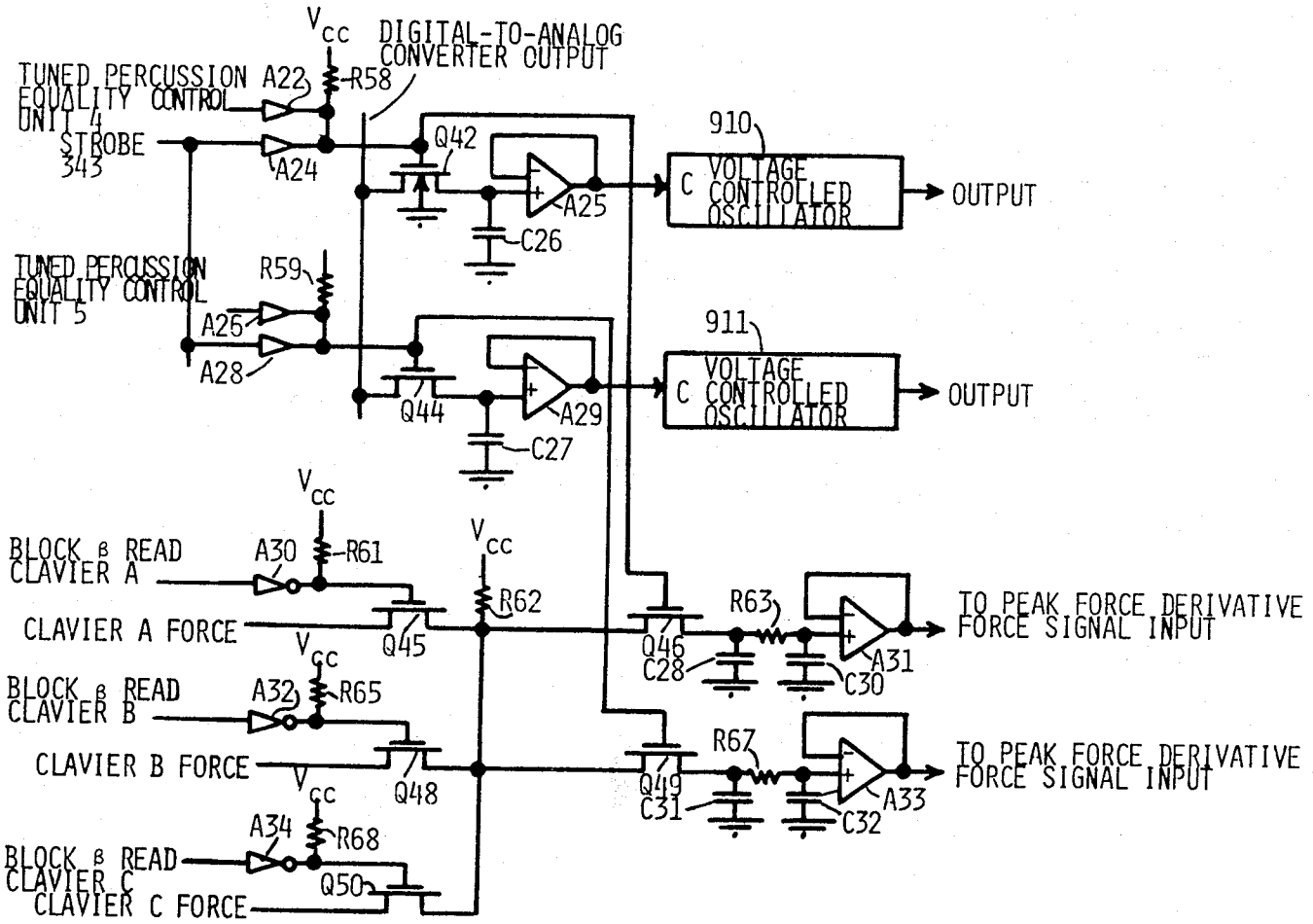
FIG. 31. SOUND GENERATOR COMMON SYSTEM FOR TUNED PERCUSSION.

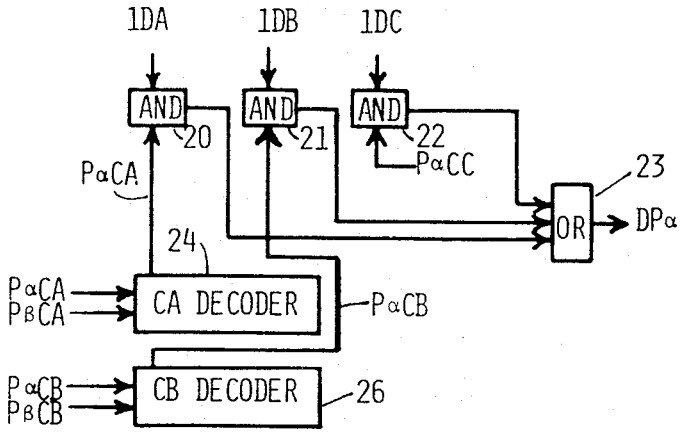
FIG. 32. CIRCUIT FOR GENERATING PAIR DOUBLED SIGNAL.
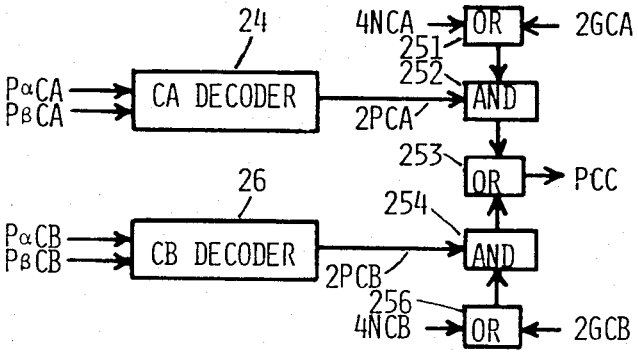
FIG. 33. CIRCUIT FOR GENERATING THE PAIR COUPLED SIGNAL.
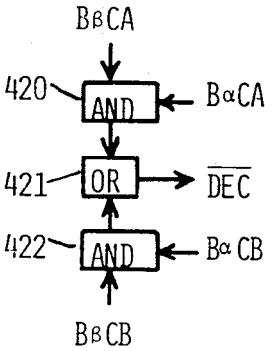
FIG. 35. CIRCUIT FOR GENERATING THE DECOUPLING SIGNAL FOR TUNED PERCUSSION
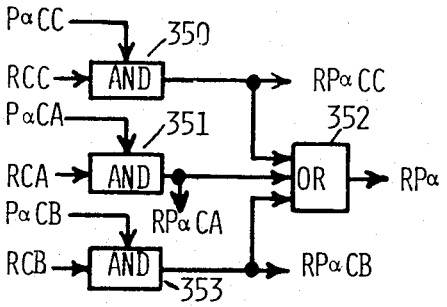
FIG. 34. CIRCUIT FOR GENERATING THE PAIR α READ SIGNALS FOR EACH CLAVIER.
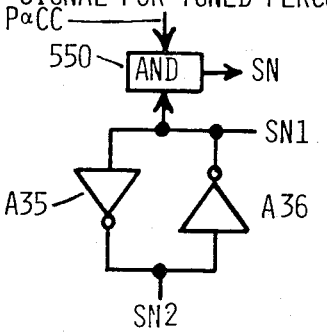
FIG. 36. CIRCUIT FOR GENERATING NONPERCUSSIVE SUSTAIN SIGNAL FOR CLAVIER C (PEDALS).

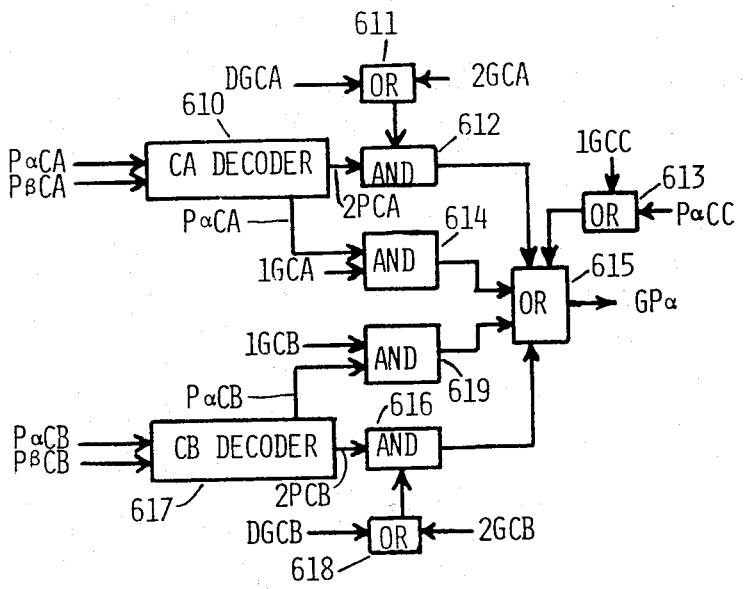
FIG. 37. CIRCUIT FOR GENERATING THE PAIR α GLISSANDO SIGNAL.

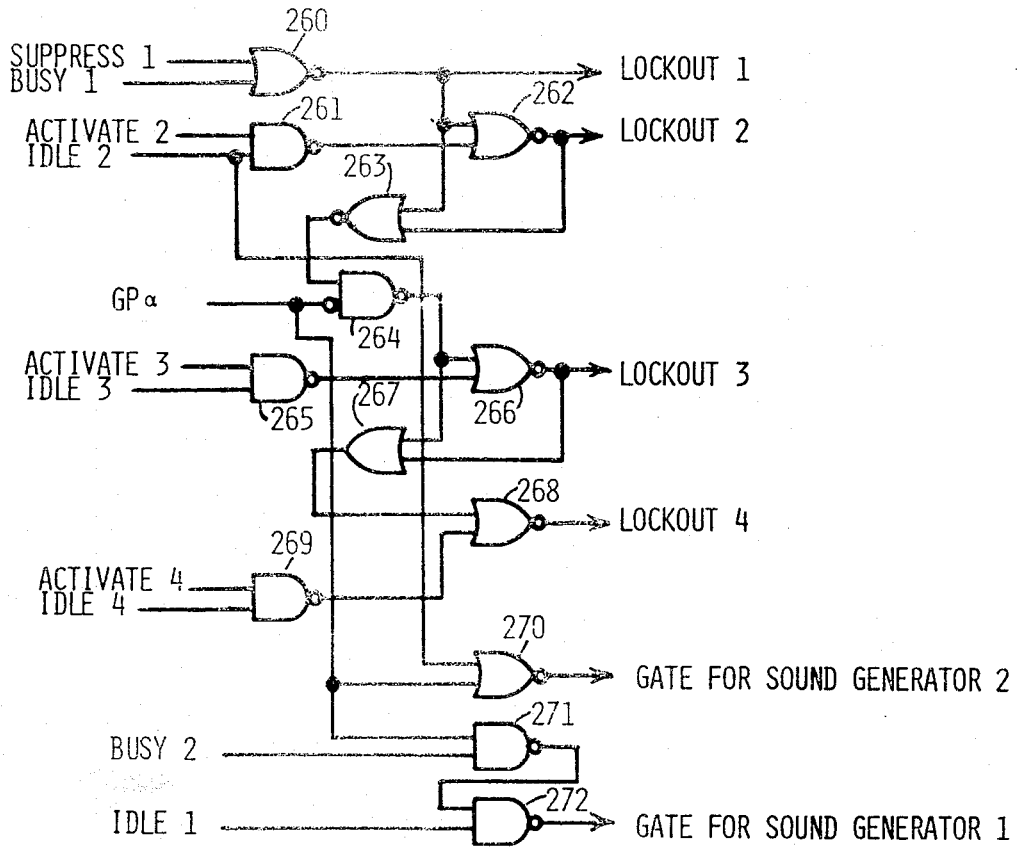
FIG. 39. CIRCUIT FOR GENERATING LOCKOUT WITH SUPPRESSION.

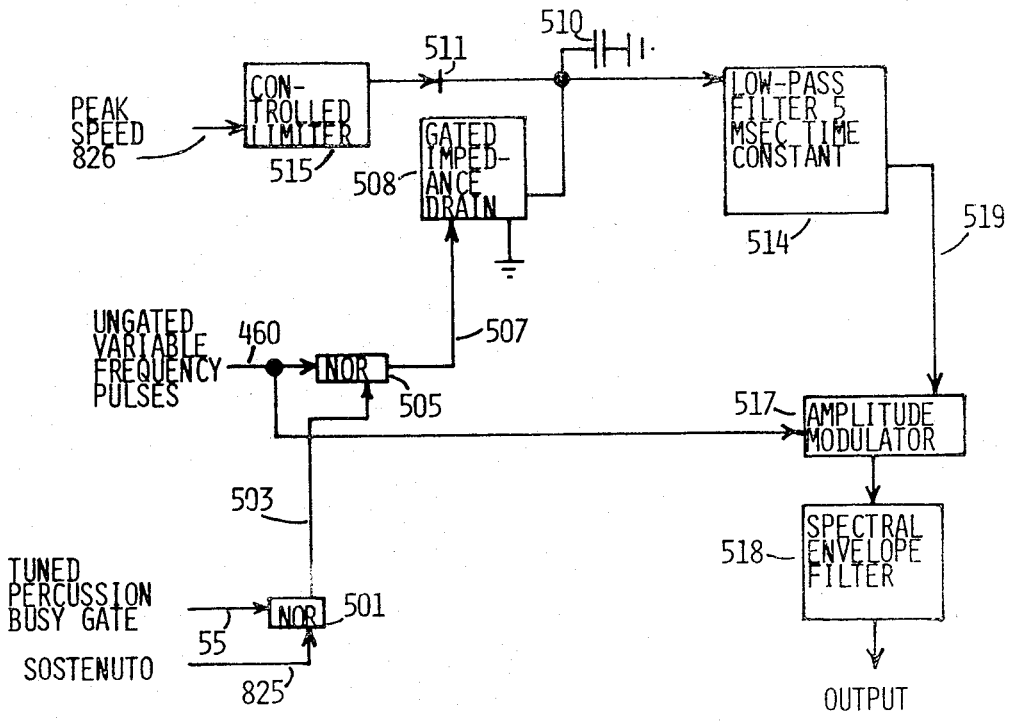
FIG. 40. SOUND GENERATOR FOR BANJO.

MUSICAL INSTRUMENT

This application is a continuation of application Ser. No. 714,527, filed Aug. 16, 1976, now abandoned.

SUMMARY OF INVENTION

This invention is based on the invention in abandoned patent application Ser. No. 148,514, dated June 1, 1971 and comprises improvements therein.

As in the previous invention, the switching system connects tone generators only to those notes that are depressed. Unlike the previous invention, the association of a tone generator with a control unit, which provides the tone generator with frequency information, continues as long as possible, even after the associated note is released and until the control unit is needed to attend another note. Further, the note address is digitally designated and remembered. In the glissando mode, the address of the note of the pair involved in the glissando that was released last must be remembered and the voltage-controlled oscillator involved must have continuing access to this address. As before, only as many tone generators are needed as notes that are simultaneously sounding. Sequential startup logic is used for a control unit, instead of state logic.

The present features are very advantageous: The control signal may be continuously and accurately supplied to a voltage-controlled oscillator even after the associated note has been released. Drift of the frequency of the voltage-controlled oscillator is thereby eliminated no matter how long the decay of a note lasts, even with a long sostenuto; expensive storage elements, such as a very low leakage capacitor and high input impedance operational amplifier in voltage follower configuration, are not needed. This matter is of considerable practical importance for the tones of those sustained percussion instruments having a long decay, such as the vibraphone, harp, or sostenuto piano. There must, however, be independent address storage and idle-busy registers with this scheme.

In contrast to the embodiments in the previous patent application, the control units are activated according to a fixed priority rule or age-dependent rule, the first being used for nonpercussive and the second for percussive instruments. The next control unit is ready immediately after activating the current unit, thus eliminating the need to scan all control units explicitly to find an idle one. The fixed priority rule enables double glissandos, as will be seen. It also allows one to control different tone colors from the same clavier under certain restrictions, which can be removed by yet another embodiment of the lockout circuits. The fixed priority rule also removes players' objections to delayed onsets, needed to improve choral effects, because the first control unit can be undelayed and the others delayed.

The age-dependent feature minimizes the effect of stealing a busy control unit for association with a newly depressed, as yet unattended, note by reassociating the sound generator that has been associated for the longest time with its note and is presumably among the weaker sounding notes. Age-dependent choice of control units can be overridden to prevent the buildup of sound generators on a note that is repeatedly struck.

A parallel lockout arrangement of the control units makes it simple to activate identical control units or blocks thereof from different claviers. Additional control units, each with a defined priority, may also be added simply by connecting more units into a stacking, lockout line. Thus, any plurality desired can be achieved.

An individual vibrato is available to each note by sidewise motion of the note. The strobing interval is divided into two parts: one for the normal strobing interval in which information is gathered relating to the force with which a note is depressed and a second interval in which two opposing, equal amplitude fast pulses are coupled to the base of each note transistor through individual variable capacitors, one pair being associated with each note, the unbalance thereby determining the degree and direction of sidewise motion of the associated note. This unbalance is measured and converted to a potential that perturbs the frequency of the associated voltage-controlled oscillator.

A voltage-controlled oscillator is disclosed that is extremely linear over the full range of the instrument. The voltage-controlled oscillator is basically a conventional precision sawtooth generator, implemented by an operational amplifier integrator, followed by a level detector that resets the integrating capacitor. If the potential traversed by the integrator were precisely the same regardless of the potential applied to the control frequency input, the reset time would be a constant; this produces a nonlinear potential-frequency characteristic. The effect can be precisely compensated by resetting to a potential proportional to the input frequency controlling potential The digital-to-analog convertor is designed so that the frequency ultimately produced by a voltage-controlled oscillator is dependent only on resistor ratios and the potential offsets of operational amplifiers, which are small, and not on absolute potential references: The frequency of a voltage-controlled oscillator is dependent on the ratio of a reference potential and the potential applied to a resistor the current through which is integrated. The reference potential at which the integration of the output of the digital-to-analog convertor stops and the output of that convertor all scale together, so that the period of integration and, hence, the period of oscillation is invariant to the reference potential, at least in lowest order, and dependent primarily upon resistance ratios.

A switching system is disclosed that is particularly useful for controlling tone colors, as well as other functions. The ON impedance of the switch may be high, so that switching will take place even if the contacts are heavily oxidized. The switching system provides latching via an extension of the flip flop concept to three or more states of the system. Control units are switched from one clavier to another in pairs because of the need for pairs of control units for glissando of notes and doubling.

To eliminate the effects of striking a key off center or sidewise initially, the potential used for vibrato control is restored to the nominal value for the unperturbed frequency for a predefined time at the beginning of the depression of a note. This circumstance recognizes that a vibrato almost always starts with a zero amplitude and builds up with time to a more or less stationary value in traditional musical instruments.

The peak speed, maximum force derivative circuit is comprised of a combination of a differentiator, a sample and hold circuit, and a reset circuit all in a closed loop, all of which uses an operational amplifier and a junction, field-effect transistor.

BACKGROUND OF THE INVENTION

The philosophy of and features desired in new musical instruments are discussed in Melville Clark, PROPOSED KEYBOARD MUSICAL INSTRUMENT, J. Acoust. Soc. Am., 31, 403–419 (1959). The instruments conceived there, in a preceding patent application Ser. No. 148,514, dated June 1, 1971, and here are real time, electronic systems on which a player may perform. The instruments are controlled by keys or pedals on which it is possible to play many notes simultaneously (multitonal capability) with one or more tone colors (multitimbral). In musical instruments belonging to this class, it is necessary to provide a separate tone generator, such as an oscillator or frequency divider element, for each note. Further, such an organization severely limits the resources that can be provided to generate and control the tone color of each note because of the cost involved. Usually these resources are limited to those that can serve all notes in common associated with a particular tone color.

In practice, it is observed that a keyboard instrument is provided with many more keys and pedals than are ever sounding, much less played, at any one moment. Thus, the equipment serving most of the notes lies idle most of the time. For example, a practical instrument may be provided with two 88 note keyboards and one 32 note pedalboard or 208 notes in all. A reasonable upper limit to the number of notes that can be played at any one time is 14, because a person has only 10 fingers and 2 feet. (He might play as many as 4 notes with 2 feet using both his heel and toe of each foot. It is recognized that more than one note may be played by a finger or toe or heel on very rare occasions. It will be seen that this possibility can be accommodated. A search of literature for pipe organs reveals that at most 12 notes are in practice ever required to be played simultaneously, and this requirement is very rare indeed.) Thus, approximately 14 ($208/14 \approx 14$) times as many notes are provided as a player can possibly actuate at any one time. Of course, for a few tuned, percussive instruments with a long decay, e.g., vibraphone, harp, or sostenuto piano, more notes will be sounding than played. There might perhaps be as many as 20 or even 25 notes sounding simultaneously (say 3 notes per octave, 7 or 8 octaves for a very long arpeggio), but even for this extreme case, the number of notes sounding is much less than the number of notes provided and greater than can probably be perceptually appreciated.

A preceding patent application Ser. No. 148,514, dated June 1, 1971, disclosed a switching system that made it necessary to provide only as many tone generators as the maximum number of such generators that one desires to sound at any one time. This switching system is sufficiently simple that far greater resources at a given cost can be associated with each note of the instrument for the generation and control of the timbres associated with that note. Further, since usually one can accept a limit of 4 or fewer notes being sounded simultaneously for the nonpercussive instrument sounds and perhaps 12 or so for the sustained, tuned percussive sounds, it is possible to design practical instruments with even greater reduction in complexity.

In order to create an instrument with which the player can artistically express himself, it is vital that information relating to the force with which a note is depressed, the speed with which it is depressed, the sidewise force or displacement of the key, and so forth be transmissible to the sound generators in order to control the instantaneous intensity with which the note sounds, the waveshape, and the instantaneous frequency of the note, which may depart from the nominal frequency associated with the note. Most systems confine themselves to merely communicating ON/OFF information to the sound generators and are gravely lacking in expressiveness. Other systems may provide some primitive expressiveness.

The structuring of the present class of instruments is then very different from that of the usual electric organ, synthesizer, or what have you. Basically, the switching system connects a tone generator only to a note that is depressed. Thus, only as many tone generators need be provided as notes that are simultaneously sounding. Only a small number of connections need to be provided to the keying system. The generation of new and unusual sounds is trivially facilitated. Sound generators compatible with electronic music studio equipment are made possible A monotonal capability is feasible in which only one note can be sounded on a particular clavier at any given time. The addition of more tone colors is simple and major modifications are obviated. The design is inherently modular. The frequencies of the notes of a clavier may be easily changed over a wide range. Thus, one may readily tune the instrument to different frequency standards. Transposition is easily accomplished automatically by the instrument so that the performer need not be burdened with this choice. A clavier may be divided in timbre, one tone color being provided at one end and another being provided at the other end. Thus, without adding to the complexity, advantage may be taken of the fact that some simulated instruments require 80 or more different notes, whereas others require as few as 12. It is practical to provide a clavier individual to each timbre. Tunings in other temperaments are easily achieved. For example, a piano is commonly tuned to a modified equal temperament, called the Railsbeck stretched scale, in which the low notes are somewhat lower and the high notes somewhat higher than would be dictated by strict adherence to an equal tempered scale. The keyboard interval may be easily changed to a microtonal scale. Separate power amplifiers and speakers can be used for each note sounded. Thus, since the partials of many musical sounds are harmonic and since harmonic distortion is much less perceivable than intermodulation distortion, efficient and inexpensive loudspeakers can be used. Interharmonic distortion will be absent simply because no partial nonharmonically related to any other is presented to a particular loudspeaker. Truly independent tone colors can be generated when several instruments play the same note (doubling). This is essential; the waveforms will be phase incoherent. With many designs, the several waveforms are phase coherent, and a tone color is created that is the average of the tone colors of the several instruments doubling each other. It is practical to provide noncontacting keys and/or pedals. These are relatively free of wear compared with other keying methods and free of electrical and acoustic noise problems. The sounds produced may be controlled by the speed with which a key or pedal is depressed. This makes possible intensity control of percussive instruments and attack control of nonpercussive instruments. The sounds produced may also be controlled by the force with which a key or pedal is depressed. This feature can be used for the intensity and/or timbre control of nonpercussive instruments. The same transducer may be used for speed sensing, force sensing, and ON/OFF control, thereby reducing costs. Two independent sensors can be accommodated by each key or pedal without any basic circuit modification. Either key and/or pedal or external control of percussion sustain provides a sostenuto feature for the percussive instruments. Glissandos may be played easily and precisely by controlling the forces of depression of two notes when the instrument is in the glissando mode. A natural, sustained decay transient of the proper frequency can be produced after the related note is released. Sustained, percussion sounds of the proper frequency can be produced.

The present invention is an improvement of that previously disclosed in patent application Ser. No. 146,514, dated June 1, 1971.

BRIEF DESCRIPTION OF THE DRAWINGS

FIG. 3 is a block diagram of the digital-to-analog convertor used to create the potentials that control the voltage-controlled oscillators.

FIG. 4 is a schematic diagram of the master clock for the logic of the system.

FIG. 5 is a block diagram of the detector that senses whether or not a note being interrogated by the multiplexer is depressed.

FIG. 6 is a block-schematic diagram of the circuit that determines the force with which a note is depressed.

FIG. 9 is a schematic-block diagram of the circuitry used in connection with the vibrato of a note.

FIG. 10 is a block diagram of the control units showing their relation to each other and various other parts of the whole system, such as the demand, lockout, and stacking circuits.

FIG. 11 is a detailed logic diagram of the generator that creates the demand signal.

FIG. 12 is a logic diagram of the circuits that create the lockout signals for the control units associated with the sound generators for the nonpercussive instruments.

FIG. 13 is a logic diagram of the circuitry that makes it possible to add groups of control units.

FIG. 14 is a logic diagram of a typical control unit associated with sound generators for the nonpercussive instruments.

FIG. 15 is a logic diagram for the circuits that create the strobe and equality signals used by the system.

FIG. 16 is a block diagram of the part of the system common to various sound generators for the nonpercussive instruments.

FIG. 17 is a schematic diagram of the circuit used to sample and hold the potential that controls the frequency of a voltage-controlled oscillator.

FIG. 18 is a schematic diagram of the circuit used to sample and hole the potentials that correspond to the force with which corresponding notes are depressed, both notes being associated with a particular pair.

FIG. 19 is a schematic diagram of the circuit used to determine which of two signals, in this case force signals, is the greater.

FIG. 20 is a schematic diagram of the circuitry used to sample and hold the vibrato signals associated with a particular pair of notes, including the necessary circuit modifications when the system is put into the glissando mode.

FIG. 22 is a schematic diagram of a variable resistance bridge controlled by the duty cycle of a pair of force-controlled oscillators.

FIG. 23 is a schematic diagram of a voltage-controlled oscillator used in connection with a sound generator.

FIG. 24 is a schematic diagram used to determine the greatest value of the derivative of the force with which a note is depressed and a logic diagram used in the control of this peak derivative circuit and the first member of a particular pair of sound generators.

FIG. 25 is a logic diagram for the gating circuit used to control the second member of a particular pair of sound generators.

FIG. 26 is a logic diagram of a multistate switch used in connection with the tone color control system in the instrument.

FIG. 27 is a schematic diagram of the French horn tone generator used in the instrument, together with logic used to control it.

FIG. 28 is a logic diagram for a control unit used in association with sound generators for percussive instruments.

FIG. 29 is a schematic diagram of the run-up circuit used in association with the percussive-instrument lockout circuits.

FIG. 30 is a block-logic diagram used to generate the lockout signals for the control units used in association with the sound generators for percussive instruments.

FIG. 31 is a schematic diagram of the part of the system common to several tone generators for tuned percussion instruments.

FIG. 32 is a logic diagram for the circuit that generates a signal indicating that a particular pair is to be doubled.

FIG. 33 is a logic diagram of the circuit used for generating a signal indicating that two pairs of sound generators and associated control units (4 of each) are coupled, i.e., each pair behaves in recognition of the behavior of the other pair.

FIG. 34 is a logic diagram for the circuit that generates a signal indicating that a particular pair associated with a given clavier is to be read.

FIG. 35 is a logic diagram for the circuit for generating the block decoupling signal for the two tuned percussion blocks of control units and associated sound generators.

FIG. 36 is a logic diagram of the circuit for generating the nonpercussive sostenuto signal for the pedal clavier, i.e., clavier 3.

FIG. 37 is a logic diagram of the circuit for generating the glissando control signal for a particular pair.

FIG. 39 is a logic diagram of a lockout system used particularly for smaller instruments and displaying the suppression inputs and gates.

FIG. 40 is a block diagram of a banjo sound generator.

NOTATIONS AND DEFINITIONS

Figure 1:
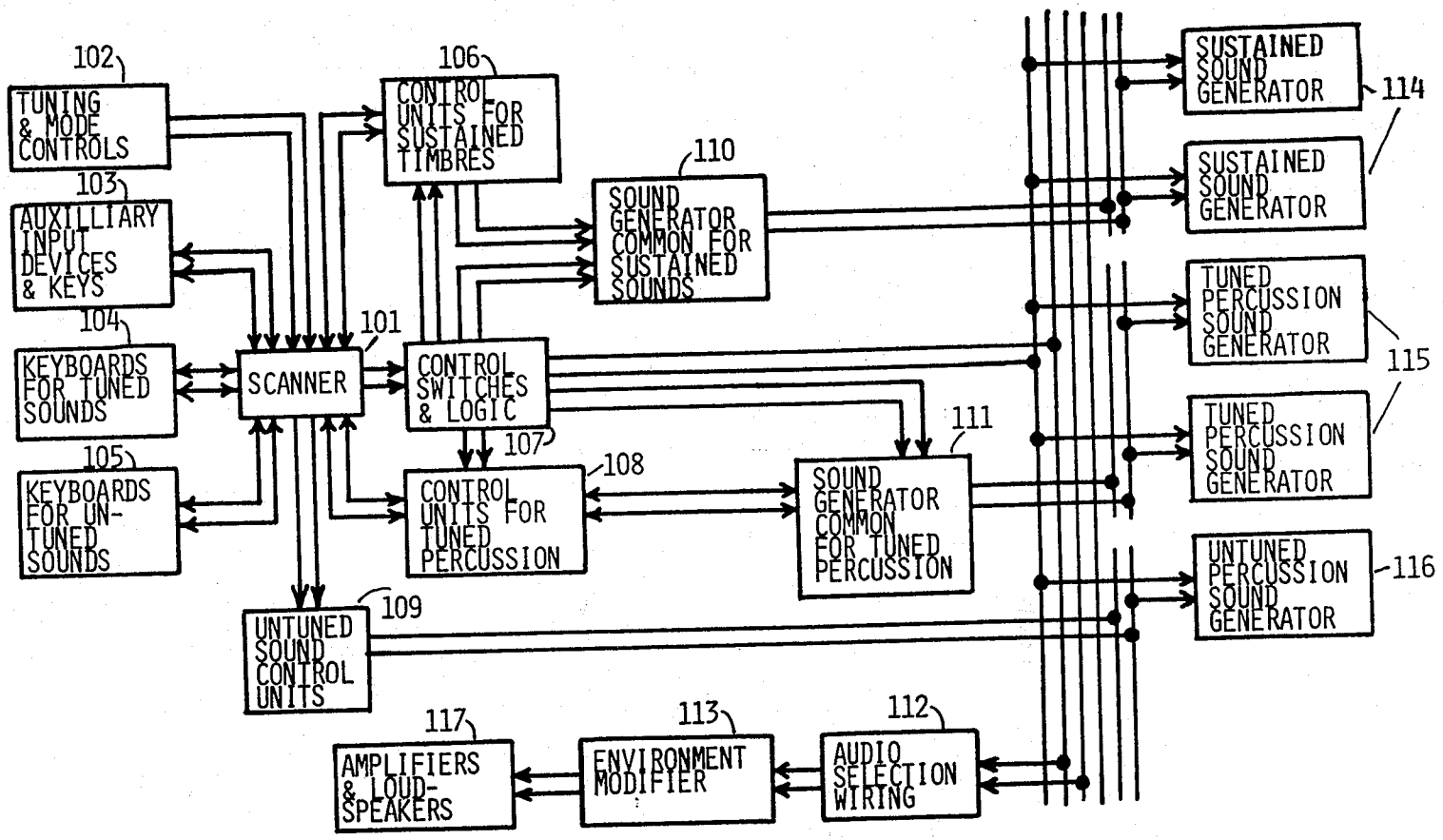
FIG. 1 is a block diagram of the whole system showing the relation of one component to another.

The following customs are observed in this application:

Doubling refers to two instruments, whether of the same or different tone colors, playing either the same notes (unison doubling) in the same rhythm or notes related by octave intervals (octave doubling). All notes so related are called an element of music. Music almost always is comprised of only a few elements, commonly 1, 2, or 3, less frequently 4; 12 is perhaps an upper limit for music commonly played.

The plurality of an instrument denotes the number of different notes (and elements) that can be sounded simultaneously. Thus, a plurality of 4 suffices for the nonpercussive instruments, but a higher plurality is needed for certain tuned percussion or sustained instruments, such as the vibraphone, piano with sostenuto, or harp, although not because so many elements are involved.

A nonpercussive instrument is one having a steady state or pseudo steady state part associated with its sound. A percussive instrument is one lacking this part. Thus, a violin played arco (bowed) is nonpercussive and played pizzicato (plucked) is percussive. Percussive instruments may be tuned or untuned, i.e., having a definite frequency associated with the notes or not, respectively. Certain percussive instruments, such as the piano, may be sustained, when in the sostenuto mode or nonsustained, in which case they stop sounding quite rapidly when the note is released. The part of a signal preceding the steady state for a nonpercussive instrument is called the attack transient; the part following the steady state is called the decay transient. The tones of percussive instruments are primarily comprised of a decay transient.

Two components are said to be coupled if the behavior of either reflects the behavior of the other; otherwise, they are said to be decoupled.

A, B, and C are used to denote particular ones of three claviers. A clavier may be a keyboard or a pedalboard. Tone generators are grouped in pairs $\alpha$ and $\beta$. 1, 2, 3, and 4 are used to distinguish the various control units for nonpercussive tone generators; these numbers may be much higher for the control units associated with the percussive tone generators. P will denote that a pair is being discussed; C that a clavier is denoted; R means that the following quantity is being read; D means that the following quantity is doubled; B denotes which block of two is being considered; DEC refers to a decoupling signal; PCC refers to the pair coupling signal; SN denotes the following nonpercussive quantity is being sustained by a sostenuto device; SP denotes that the following percussive quantity is being sustained; DG designates a glissando; 1G is a one note glissando; B denotes that the control unit denoted by the following quantity is busy; I that it is idle. For example, P$\beta$CA denotes that pair $\beta$ is present on clavier A; DPd means that pair $\alpha$ is doubled; 2PCB means that two pairs are present on clavier B; 2BCA means that two blocks are present on clavier A; RCA means that clavier A is to be read; 1GCB means that the pair on clavier B is to provide a one note glissando; 2PCA means two pairs are present on clavier A.

A small o attached to a logic symbol denotes negation of the signal

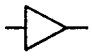

denotes an amplifier, and, thus,

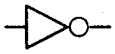

denotes an invertor; both

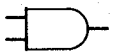 and AND are used to denote AND gates, and

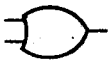 and OR are used to denote OR gates. Exclusive OR's are not used explicitly. AND and OR gates are always denoted by their physical representation with respect to positive logic, and not their logical functions. In other words, a NAND gate with negative logic at the inputs will behave logically as an OR gate. Further, the inverting properties of a NAND or NOR gate will be indicated explicitly by a 0 at the output. A bar over a quantity denotes the negation thereof. In actual implementation NAND and NOR gates are, in fact, used. However, it often clarifies the logic to explain operations in terms of AND and OR logic, even though not so widely available as the NAND or NOR logic, which are preferred. De Morgan's theorem is used to transfer from one to other and to go from negative logic to positive logic, and conversely. Unless otherwise stated, positive logic is assumed.

A flip flop is, of course, a bistable multivibrator. A univibrator is a monostable multivibrator or one shot. CLK denotes the clock input of, say, a flip flop, PRE the preset input of a flip flop, and CLR the clear input. Q denotes the assertion output and $\overline{Q}$ the negation output. R denotes the reset input and S the set input of an RS flip flop; D denote the data input of a data flip flop; J and K denote the toggling inputs of a JK flip flop. An assertion appears at the S output and a negation at the R output of a multivibrator when set, and conversely. A multivibrator changes state, regardless of the state it is in , when a suitable trigger is applied to a toggle input. An assertion applied to the R input of a counter, shift register, detector, or address register resets the device to its initial state.

A signal applied to the C input of a gate, integrator, gated device, modulator, voltage-controlled amplifier, generator, or limiter switch modulates or controls the information-bearing signal applied to the other input or controls the internal generation of a signal itself.

If information passes or is transmitted through a gate, that gate is said to be open; if information is blocked and cannot pass through, the gate is said to be closed. Analog gates may consist of bipolar or field-effect transistors with the gating signal applied to the base or gate with the current of the switched signal flowing through the other two terminals. A shunt gate shorts out some element, e.g., a capacitor, when an assertion is applied to its control terminals.

+ denotes the noninverting input and − the inverting input of an operational amplifier.

Multiple lines are often denoted by two lines with the number in a circle between the two lines denoting the number of actual lines. Lines lacking such an appendage are usually single. Ground return is usually implied. The provision of power lines to the circuits is often suppressed where the meaning is clear.

Generally, standard SSI, MSI, or LSI logic modules are used, especially transistor-transistor logic.

Unless otherwise stated, the values of resistors are in kiloohms; the values of capacitors are in microfarads.

The following groups of terms are synonyms: (AND, AND gate) in digital functions, (gate, analog gate) in analog functions, (OR, OR gate) in digital functions, (flip flop, bistable multivibrator), (univibrator, monostable multivibrator, one shot), (ON, assertion, high), (OFF, negation, low). The following terms are antonymous: (Suppression, activation), (ON, OFF), (assertion, negation).

A transistor that is conducting is said to be ON; one that is nonconducting is said to be OFF.

An assertion level implies that the level is high; a negation level implies that the level is low.

VCO is an abbreviation for voltage-controlled oscillator.

XB* denotes the busy signal of control unit X that is sustained by means of an RS flip flop if the sustain signal becomes an assertion anytime during which the busy signal is an assertion.

DETAILED DESCRIPTION

FIG. 1 is a block diagram of the instrument. Scanner 101 generates digital signals that activate the notes of keyboards 104 and 105 in sequence. Each keyboard of the set 104 is scanned in parallel with others of the set, so that corresponding notes of two keyboards are interrogated simultaneously. The keyboards 105 for untuned sounds are scanned serially with the keyboards 104 and may be considered to be extensions of the keyboards 104. The scanning signals are generated by a clock internal to the scanner; the clock stops momentarily when a note is found to be depressed or when a control unit 106 or 108 contains an address equal to the address of the note interrogated. This holdup allows precise transmission of analog signals and the settling of analog samples throughout the system.

The scanner determines whether a note is depressed. If a note is depressed and not attended by another control unit, the scanner seeks the control unit 106 or 108 that is in the idle-ready status to associate with the newly depressed note. An idle control unit is one that was found on the previous scan to have an address stored in its memory equal to the address of a note no longer depressed. An idle-ready control unit is the one control unit selected by the lockout logic to be the next one to be associated with a note, thereby transferring the control unit into the busy status. The control units 106 have a fixed priority assigned to them, so that the next one to be associated with a newly depressed note is the one having highest priority for this service. For example, if four control units are labeled 1, 2, 3, and 4 and assigned the respective priorities 1, 2, 3, and 4, then, if units 1 and 3 are busy, the next control unit to be associated with a note will be unit 2 and the second next control unit to be associated with a note will be unit 4, provided the notes associated with the control units 1 and 3 are held depressed while the new notes are depressed. Thus, the selection of control units is deterministic, giving a double glissando capability, as will be seen later. The auxiliary input device keys 103 permit the association of auxiliary input control signals with various control functions in an unambiguous manner.

The scanner circuits generate the basic pitch control potentials simultaneously and synchronously with key address generation, so that a potential appropriate for controlling a voltage-controlled oscillator is generated at the time a particular key is examined. This potential is subsequently sampled and held in the appropriate sound generator common circuits 110 and 111, and applied to a voltage-controlled oscillator.

The keyboards 103, 104, and 105 incorporate capacitance devices that create a time delay on an OR line, which is returned to the scanner, for each clavier common to all notes of that clavier. If the time delay exceeds a preset threshold, a note is considered to be depressed, and the magnitude of the delay is converted into a voltage-control signal to be subsequently sampled and held. This delay is monotonically related to the force of depression of the associated note. A pair of opposing strobe pulses is applied at a later moment to note capacitors. If the note is moved sidewise, these pulses do not exactly cancel, when coupled to the output OR buss and a resultant pulse appears on the OR buss monotonically related to the magnitude and direction of the horizontal key displacement. This signal is also sampled and held for later use.

The tuning control 102 scales the synchronous pitch-voltage control signal so that the entire instrument may be tuned while retaining the basic interval relationships.

The control units 106 and 108 respond to signals from the scanner 101 and become associated with notes that are depressed by storing the addresses of the depressed notes. Whenever the address of a control unit agrees with the address of a note currently being interrogated by the scanner and the note is not depressed, the control unit is returned to the idle-reserve status. That control unit 106 for nonpercussive timbres having the highest priority transfers to the idle-ready status, if it is not already in that status. The control units 108 for the tuned percussion may be operated in either a random selection basis or an oldest idle-ready basis. The addresses stored in the control units are compared with the address of the note being interrogated by means of the digital comparators. Equality of the addresses extends the duration of time that the scanner interrogates the note (from less than 1 μsec to 6 μsec), allowing the sampling andholding means in the sound generator common to settle to a high accuracy.

The permanence of the memory in the control units permits a sampling unit to continue to acquire the signal controlling frequency even after a note has been released as long as the control unit is not required to attend another note. This procedure permits low cost, accurate control of frequency for tuned percussion tone colors that may be required to sound long after a note is released, since the frequency determining circuits are resampled on each opposite scan of the clavier.

The control switches and logic 107 interact with the scanner, the control units, and the sampling means in the sound generator common to establish a variety of states of the instrument. For example, the control units 106 and 108 are divided into subgroups that may be activated from different claviers, the states of the switches of 107 determining the clavier-subgroup association. The subgroups may be put into doubling or the glissando modes by the switches 107.

The untuned sound control units 109 have a one-to-one correspondence with the untuned claviers 105 and, therefore, need supply only the basic sample and hold functions, speed and possibly force in this case.

The sound generator commons 110 and 111 use the information from the comparators in the control units 106 and 108 and the state-of-instrument information from the switch and logic unit 107 to sample and hold the various control signals available from the scanner and to perform elementary waveform generation. The greatest derivative of the force signal is computed in the sound generator common. The sampled and held control signal related to the horizontal displacement of a note is restored in the sound generator common to the value present 70 msec after depression of a note.

Bus lines emanate from the sound generator commons 110 and 111, and the control units 109 to the sound generators 114, 115, and 116. Basic control signals, such as force, horizontal key displacement, peak speed of key depression, frequency pulse trains, idle-busy gating signals, information concerning the association of tone generators with claviers, audio output lines, and power are bussed to the sound generators. These may preferably be constructed in a modular manner so that tone generators of various tone colors may be added or subtracted from the resources of the complete instrument.

The audio selection and mixing controls provide basic routing and control of the signals generated by the sound generators. These functions include gain, tone, and mixing functions appropriate to the environment modifiers and amplifying sections 113 and 117. Preferably, the output of each of the nonpercussive sound generators is applied to an individual loudspeaker. This method eliminates the generation of interharmonic components, regardless of the nonlinearity of the speakers, since each sound generator produces only harmonically related components. Such a procedure permits inexpensive loudspeakers to be used. Additionally, spatial identity and a desirable spatial mixing are conferred upon the sounds.

Figure 2:
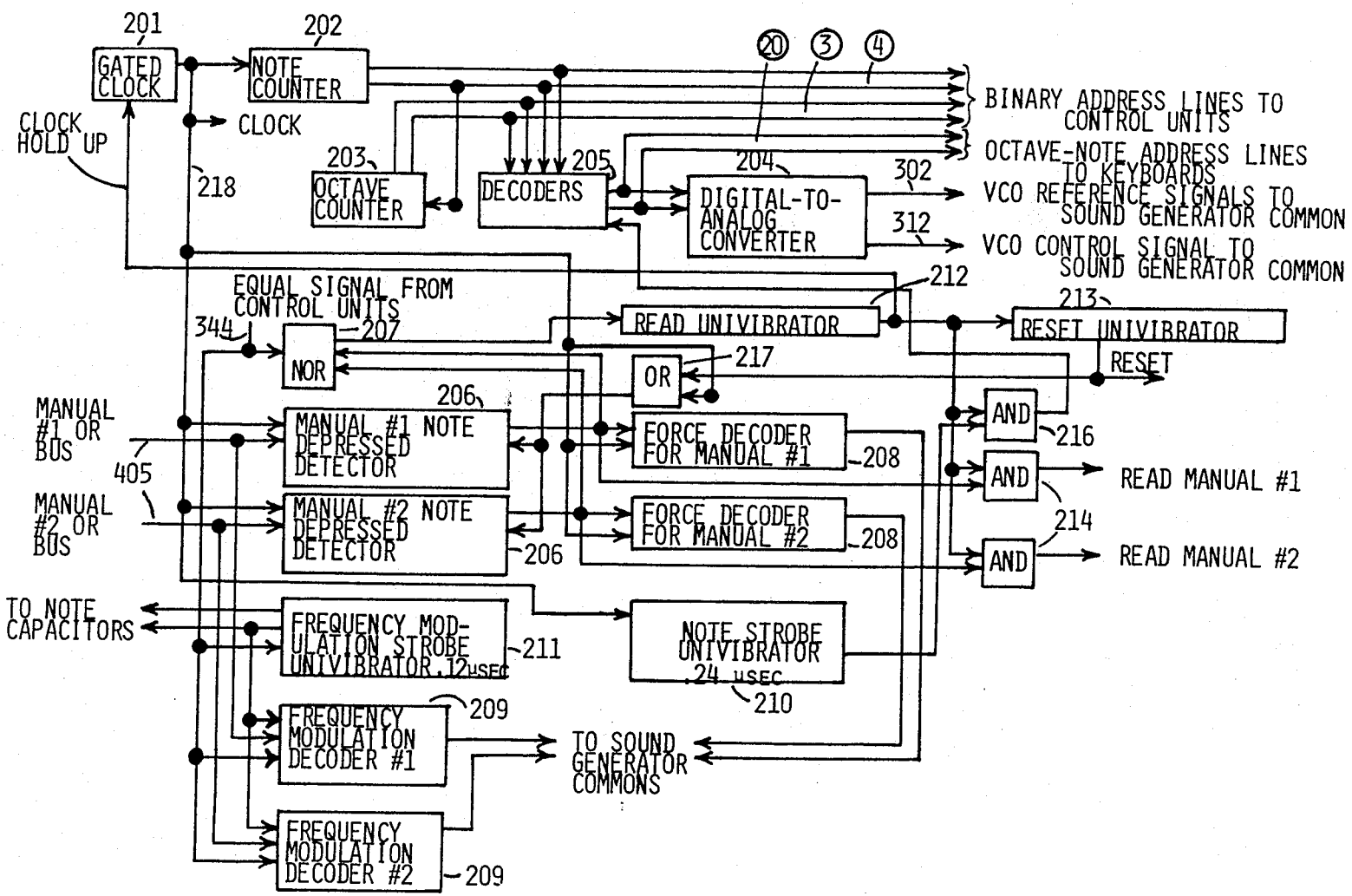
FIG. 2 is a block diagram of the multiplexing system.

The scanner shown in FIG. 2 provides the basic timing-multiplexing signals that interface the claviers with the sound generation apparatus. The gated clock 201 generates pulses at about 1 Mhz, and drives the note counter 202, the note depressed detectors 206, the force decoders 208, and the note strobe univibrator 210. The note counter 202 drives the octave counter 203. The note and octave counters generate binary addresses for the notes and octaves. These addresses are subsequently used by the control units and are decoded and applied to the claviers by the decoders 205. These decoders provide a 1 of 12 note address and a 1 of N octave address, N being the number of octaves. A single note of one of the claviers 104 or 105 is addressed by AND-ing together one note and one octave address line.

The clock 201 reference pulse is applied to the note depressed detectors 206. A common OR line 405, one for each clavier, is applied to an individual note depressed detector. The fall time of the OR line at the start of the period of time a particular note is addressed is related to the capacitive loading and, hence, the force of depression of the note of interest. The note depressed detector 206 determines the time taken for the relevant OR line 405 to reach a prescribed level. If this time exceeds a prescribed minimum, a flip flop within the appropriate note depressed detector is set, and this flip flop drives the NOR gate 207. The force decoder 208 provides a potential to sound generator common proportional to the time required by the relevant OR line 405 to reach the prescribed level. The note depressed detector 206 is reset by either the reset signal from the reset univibrator 213 or by the clock via the OR gate 217.

If any note depressed detector detects a depressed note or if an equality exists between the interrogated and stored note addresses in any control unit, the output of the NOR gate 207, which drives the read univibrator 212, which in turn drives the gated clock 201, inhibits further generation of clock pulses until the filp flop in the note depressed detector is reset by the 1 μsec reset univibrator 213, which is triggered ON by the trailing edge of the read univibrator 212 pulse. The pulse created by this read univibrator 212 is of sufficient duration to permit sampling and holding of the various analog control signals in rhw appropriate sound generator commons 110 and 111. A read signal related to the clavier in which the depressed note occurs is generated by an AND gate 214, which ANDs the related note depressed detector and read univibrator outputs.

The gated clock 201 also drives the 0.24 μsec note strobe univibrator 210. The output of this univibrator 210 is ANDed by gate 216 with the output of the 5 μsec read univibrator 212. The output of AND gate 216 drives the decoders and, thereby, defines the note strobe pulses sent to the keyboards.

Figure 7:
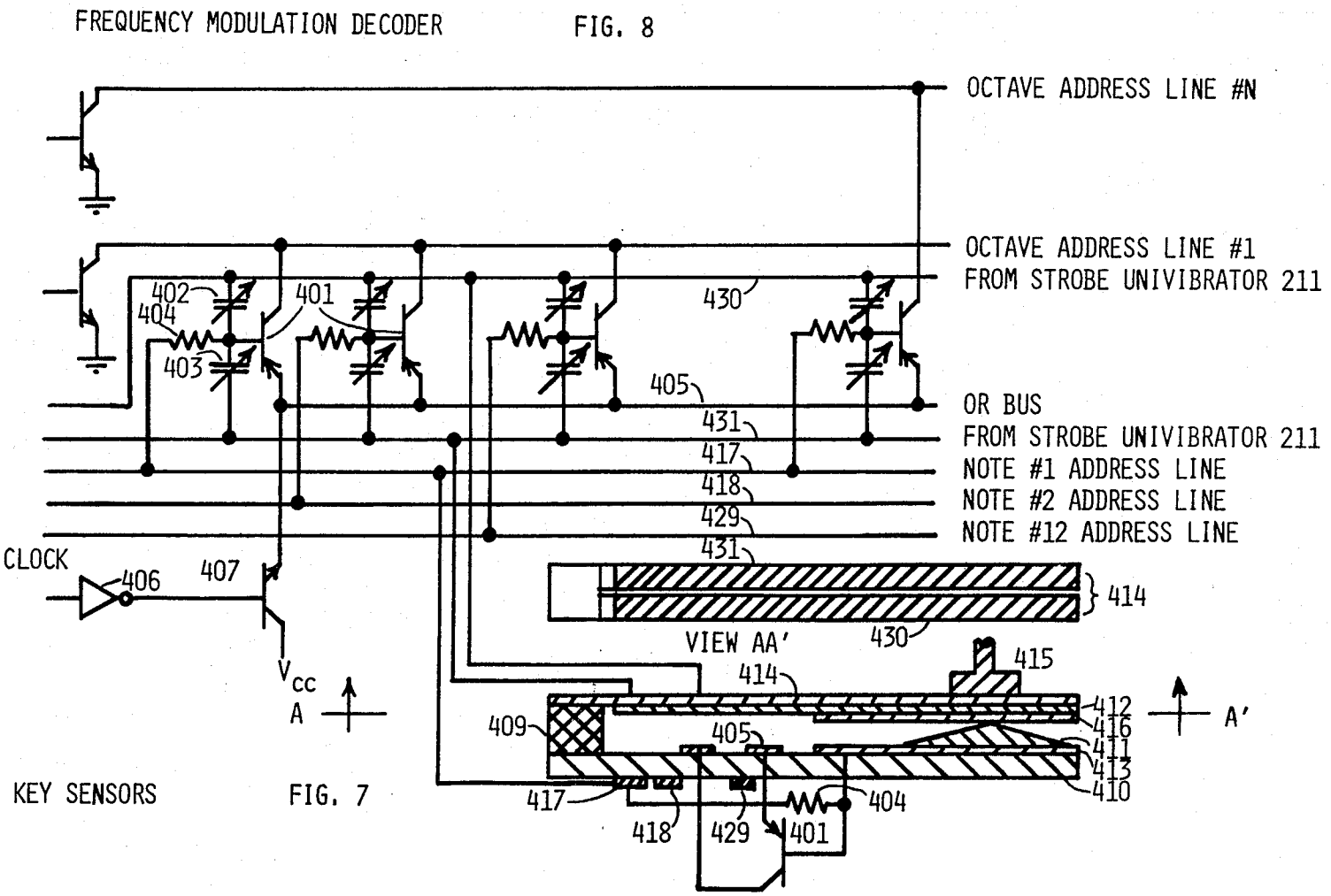
FIG. 7 is a schematic and mechanical diagram of the key sensors.

The frequency modulation strobe univibrator 211 is triggered ON by the trailing edge of an equality signal 344, which is generated by any control unit with a stored note address equal to that of the note being interrogated. The frequency modulation strobe univibrator 211 generates a pair of pulses of equal magnitude and opposite polarity of 0.12 μsec duration. There are two capacitors and one resistor connected to the base of each note transistor, as shown in FIG. 7. One of the 0.12 μsec duration pulses drives the side not connected to the base of the note transistor of one of these capacitors; the other pulse drives the side of the other capacitor not connected to the base of the note transistor. The capacitors and resistors define a time constant. The capacitances of these capacitors are varied by the force applied to them through the coacting note. Horizontal displacement or rotation of a note causes the pair of coupling capacitors excited by univibrator 211 to be unequal in value. This imbalance causes a pulse to appear on the OR lines 405 the magnitude and polarity of which are related to the magnitude and direction of horizontal displacement or rotation of the note. This pulse is sampled and held during the strobe interval by applying the output of the strobe univibrator 211 to the OR lines 405 and to the frequency modulation decoders 209, which provide a potential proportional to the imbalance of the two note capacitors 402 and 403. The sampled and held frequency modulation signals are then available for further sampling and holding in the sound generator commons for the duration of the read univibrator 212 pulse.

The outputs of the note and octave decoders 205 are applied to the digital-to-analog convertor 204 in addition to the claviers. This digital-to-analog convertor 204 generates a potential appropriate to control a voltage-controlled oscillator to be described later and synchronously with the generation of the address of the appropriate note. Thus, the voltage control signal for all voltage-controlled oscillators is common to all claviers. In addition, this digital-to-analog convertor is so designed that all potentials may be scaled uniformly so that the final frequencies generated by the voltage-controlled oscillators are dependent only upon resistor ratios and offset characteristics of operational amplifiers.

The read univibrator 212 pulse is of sufficient duration (5 μsec) to permit the analog potentials, such as those corresponding to force of note depression, frequency modulation, frequency control, to be sampled accurately and held in the sound generator commons. This univibrator 212 is driven by the NOR gate 207 and in turn drives the reset univibrator 213, which generates a 1 μsec reset pulse to reset the note depressed detectors and to effect certain operations in the control units 106 and 108, as will be described later.

FIG. 3 is a block diagram of the digital-to-analog convertor. A precision reference potential is generated by a Zener diode 301. This potential serves as a reference for the voltage-controlled oscillators; this potential is inverted and scaled by the resistors 303 and 304, and the operational amplifier 305; and is, thus, essentially applied across the input terminals of the operational amplifier. This amplifier is used in a traditional configuration; it will track any change in the reference potential, except for very small errors normal to operational amplifiers. The resistor 304 is the tuning control that changes the ratio of the final output signal of the digital-to-analog convertor and the reference 302, thus changing the frequency produced by the voltage-controlled oscillators. The output of the inverter amplifier 305 drives a note resistor divider chain 306; this chain generates a set of potentials the ratios of which are those of the ratios of the frequencies of the notes of a single octave. By changing the values of the resistors 306 different temperaments may be implemented. The taps of the resistor divider 306 are applied to field effect transistors used as transmission gates 308. One and only one of these gates is open at any given time. The outputs of field effect transistor gates 308 are tied together and applied to the impedance buffer amplifier 309, which again is merely an operational amplifier in a voltage-follower configuration. This amplifier 309 drives an octave resistor divider chain 335, which divides the potential applied by the voltage follower 309 by integral powers of 2 by means of the octave field effect transistor gates 310. The output is again impedance buffered by a voltage follower 311. The output of the digital-to-analog convertor 312 is, thus, a potential proportional to the desired frequency of the note the address of which is applied to the field effect transistor switches 308 and 310. This potential is determined solely by that of the Zener reference 301 and the resistance ratios of the voltage dividers 306 and 335, and is applied to the input of the voltage controlled oscillator of FIG. 23.

FIG. 4 is a schematic diagram of the gated clock used to drive the scanner and consists of a dual input NAND gate 313 used in a Schmitt trigger configuration, with negative feedback applied to one of the input terminals. The frequency of the clock is determined by the values of the resistor 314 and the capacitor 315, and the hysteresis of the Schmitt trigger 313. If during the time the output 316 of the Schmitt trigger 313 is positive and the second input from the NOR gate 207 is negative, the clock output is held in the ON (positive) state until the second input goes positive, at which time the clock free runs again.

FIG. 5 displays the note depressed detector circuit that senses whether or not a note is depressed. The level amplifier 319 scales and biases the output on the common OR line to a value appropriate for the Schmitt trigger 320. The triggering of the Schmitt trigger 320 is delayed in relation to the clock signal by an increase of capacitance applied to the note gating emitter followers connected in common to the OR line. The output of the Schmitt trigger 320 is inverted by the inverter 321 and applied to the AND gate 322 the second input of which is driven by a univibrator 318, which is, in turn, excited by a delay univibrator 317. The delay univibrator is driven by the clock signal. The output of the overlap univibrator 318, thus, occurs a fixed time after the clock signal goes ON. If the output of the inverter 321 has not gone OFF before the univibrator 318 goes ON, a pulse is generated at the output of the AND gate 322, thus setting the flip flop 323. If the inverter 321 output does go OFF before the univibrator 318 pulse occurs, the AND gate 322 output is held OFF and the flip flop 323 stays in the reset condition, having been put into that reset condition at the end of the previous cycle by the reset univibrator 213.

FIG. 6 displays the force decoder. The force decoder converts the time delay between the occurrence of a clock pulse and the triggering of the Schmitt trigger 320 into a proportional potential. This goal is accomplished by turning OFF a shunt gate 328 applied across an integrating capacitor 329 via the inverter 327, which is driven by the clock signal. Thus, when the clock signal goes ON, the potential across the capacitor 329 begins to increase linearly, being supplied current from the current source 326, since the Schmitt trigger inverter is ON until turned OFF by the delay triggering of the Schmitt trigger 320, This Schmitt trigger is ultimately driven by the OR line of the key sensors. When the OR line does reach the threshold level of the Schmitt trigger, the current source 326 is turned OFF. A potential proportional to the delay between the clock signal and the triggering of the Schmitt trigger 320 appears on the capacitor 329. This potential is held until the clock signal goes OFF, at which time the capacitor 329 potential is reset to zero to prepare for a new note. The capacitor potential is impedance buffered by the voltage follower 330, the output of which excites circuits in the sound generator common for synchronous sampling and holding of various control signals.

FIG. 7 is a schematic drawing of the key sensors used in the claviers 104, 105, or the auxiliary input device keys 103. The sensors are excited by the outputs of the octave and note decoders 205.

The octave address lines are activated sequentially, a line being active when it is provided a current sink through the open collector outputs of the decoder 205. When active, an octave address line permits the note transistors 401 within the active octave to act as emitter followers, all emitters of the transistors for all octaves of one clavier being connected together. The bases of the transistors 401 are sequentially pulled down through the resistors 404 which are driven by the open collector outputs of the note address decoder 205. Pull down of the single active transistor 401 is delayed by the capacitors 402 and 403, the capacitances of which increase as the force of depression of a note increases. The capacitancess 402 and 403 are varied, for example, by changing the area of contact between two conductive plates 412 and 413 between which a compressible elastomer 411 is sandwiched together with a thin insulating film 416. If the key is depressed in a precisely vertical and centered manner, the capacitances of the two capacitors 402 and 403 associated with a particular note remain equal, while the total capacitance, being the sum of the two capacitances, increases. During the initial period of interrogation of a particular note, the sides of the capacitances 402 and 403 not connected to the note transistor bases are connected to reference potential sources that have a low dynamic impedance.

If an equality exists between the interrogated and stored note addresses in any control unit, the frequency modulation strobe univibrator 211 is triggered. This univibrator generates a pair of opposite polarity pulses on the excitation lines of the capacitors 402 and 403. A resultant pulse appears on the OR line 405 proportional to the magnitude and sign of the imbalance in the capacitance of the capacitors 402 and 403. The resulting pulse is sampled and held by the frequency modulation decoder 209.

In the present instrument, the variable capacitors are constructed from printed circuit boards (copper clad glass epoxy) 410 and 414 with copper cladding 412 and 413 serving as the two plates of the capacitors. The lower fixed plate carries a wedge shaped piece of conductive elastomer cemented to it, while the top plate has a thin insulating layer 416 sandwiched between the conductive elastomer and the copper cladding. As the peg 415, which is attached to the key, is depressed, the conductive elastomer 411 is squashed between the upper and lower plates, and the effective areas between the two plates 412 and 413 is increased, thereby increasing the capacitance. If the key peg 415 rotates somewhat, the upper plate, which consists of a pair of fingers, is depressed more on one side and the ratio of the capacitances 402 and 403 deviates from 1, causing a resultant pulse to appear on the common OR line 405.

Figure 8:
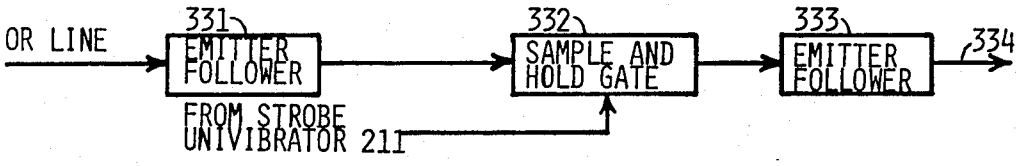
FIG. 8 is a block diagram of the circuitry that determines the amount of frequency modulation being applied by the performer to the note by sidewise motion of the note.

FIG. 8 displays the frequency modulation decoding circuitry. It is essentially a high speed, input-output buffered sample and hold gate. The emitter follower 331 provides input buffering of the common OR line from the key sensors. Emitter follower 333 provides output buffering. The sample and hold gate 332 is driven by the strobe univibrator 211, which also drives the key capacitors.

FIG. 9 is a schematic diagram of the vibrato pulse generation and detection circuitry. When an equality is discovered between the address of the note currently interrogated and that stored in a control unit, a 2 μsec, negative going OR equality pulse for the whole instrument is developed. As shown in FIGS. 2, 9, and 15, the end of this pulse triggers the 0.12 μsec frequency modulation strobe univibrator 211. The assertive and negation outputs of the univibrator 211 are buffered by the npn and pnp transistors Q57 and Q58, respectively, emitter followers. The outputs of these emitter followers drive the two lines 430 and 431, each of which is connected to the side not connected to the base of a note transistor of one set of capacitors, as shown in FIG. 7. Thus, each emitter follower is connected to one corresponding member of each pair of fingers 414 associated with each note. The negation output of the univibrator 211 also excited the base of the transistor Q60 which provides amplification, isolation, and inversion of the pulse provided by the univibrator, thereby switching the back-to-back paralleled transistors Q52 and Q53 into the conducting state, i.e., ON, and connecting the capacitor C34 (of about 1000 pf) to the emitter of transistor Q54. The two pulses of opposite polarity provided by the univibrator 211 to the keying system via lines 430 and 431 create a net signal at the emitters of the note switching transistors 401, which signal is connected to the base of transistor Q54 via line 405. Thus, the net pulse created by the imbalance in the capacitances 402 and 403 at the bases of the note transistors and connecting the lines 430 and 431 is stored in the capacitor C34. The signal on this capacitor is monitored by the Darlington connected emitter follower Q61 and Q62, and the output of this emitter follower drives a difference amplifier comprised of the transistors Q64 and Q65 connected with a common resistor R79 in their emitter circuits. A capacitor C35 (of about 100 pf) samples the quiescent OR line 405 being normally connected to this line when the equality pulse is present. At this time, the transistor Q69 is gated OFF, thereby gating transistor Q68 ON. The potential across this capacitor then provides a comparison potential to the differential amplifier comprised of the transistors Q64 and Q65 via the Darlington connected emitter follower comprised of the transistors Q66 and Q67. The output of the difference amplifier is provided by the collector of transistor Q64 and provides a quantitative measure of the imbalance between the capacitances 402 and 403 of the note transistor 401 being interrogated.

FIG. 10 is a system block diagram for four control units 901, 902, 903, and 904. In this scheme control units attend depressed notes on a fixed priority basis: If the instrument is in the 4 notes on one clavier mode, then the control units 901, 902, 903, and 904 are activated in the sequence 1, 3, 2, and 4. If the instrument is in the 2 notes doubled mode, as determined by the double pair read and the pair coupling control signals, then the first note is attended by control units 1 and 3, and the second note is attended by control units 2 and 4. If pair $\alpha$ is on a particular clavier, control units 1 and 2 attend that clavier; if pair $\beta$ is on another clavier, control units 3 and 4 attend that clavier. In the glissando mode, control units 1 and 2 coact to produce a single glissando tone using the voltage-controlled oscillator associated with control unit 1; similarly, control units 3 and 4 work together to produce a second glissando tone using the voltage-controlled oscillator associated with control unit 3. Thus, a double glissando is possible: Control unit 1 attends the first note depressed; control unit 3 attends the second note depressed; control unit 2 works with control unit 1, and control unit 4 works with control unit 3 to produce the double glissando. This association is consistent with a glissando capability when one pair of control units is on one clavier and the other pair of control units is associated with a second clavier, since control units 1 and 2 are moved from one clavier to another together, and control units 3 and 4 are moved also from one clavier to another together.

Since the control units 901, 902, 903, and 904 retain the digital address of the last note attended, this address is used to generate the proper voltage-controlled oscillator signal from the digital-to-analog convertor and to continue accurate control of the voltage-controlled oscillator even after the note has been released. Thus, the decay of percussive sounds having a long decay can be inexpensively generated that is accurately in tune, even though the previously associated note is no longer depressed. The scanner stops whenever an equality exists between the current note address of the scanner and an address stored in any control unit, giving the sampling and holding circuits ample time to settle down.

If a note was found depressed on the previous scan cycle of the scanner, the note will have been attended by a control unit (assuming not all control units were busy) and that control unit will contain an address equal to that of the note being interrogated and the control unit will be busy. This control unit will suppress the demand for the startup of a new control unit. On the other hand, if no control unit that is busy has an address equal to that of the note being interrogated, a demand is created for a new control unit by the demand generator 905; the control unit that is idle and that has the highest priority is associated with the note that is being interrogated. This selection is made by a digital lockout generator 906: Each of the lockout elements for which the associated control unit is idle locks out all other lockout elements of lower priority. When a particular control unit becomes busy, the associated lockout element is disabled so that the idle control unit having the lockout of next highest priority becomes ready for the next assignment if that requirement appears.

The demand unit creates a demand signal for the association of a control unit with a newly depressed note only if there is no other control unit with the same address as that of the note and that is busy. With respect to both the demand signal and the lockout signal, control units are treated in pairs. If a clavier has the capability of playing four notes simultaneously (said to have a plurality of 4) or if a two note glissando can be played on the clavier, then the two pairs, comprising all four control units, are coupled together in that the condition of any control unit being busy and having an address equal to that of the note being interrogated suppresses the demand signal for all three other control units. If a clavier has only a plurality of 2 or if only a one note glissando can be played on it, the two pairs of control units are decoupled, such that association of control unit 1 or 2 with a note will suppress the demand signal being generated for the other control unit, but will not suppress the demand signal for either control unit 3 or control unit 4, on the next scan even though there is a control unit already attending the depressed note, and conversely. If the pair coupling signal is assertive, the two pairs are coupled and coact; if a negation, the two pairs act independently of each other. Indeed, two notes may be doubled by decoupling the demand suppression signal within either pair: When a clavier is in the doubling mode, the demand suppression signal by the higher priority unit of a pair is inhibited, and the control unit of lower priority attends on the next scan the note already attended by the control unit of higher priority. Again, if, for example, the first pair of elements is assigned to clavier A and the second to clavier B, interaction between the two pairs of control units is not desired, and the pair coupling signal is a negation. The pair control signal is also used to cause a rearrangement of the priorities seen by the control units by reversing the input and output ports associated with control units 2 and 3 in the lockout circuitry, as will become clear later. Table 1 displays the status of the pair control signal and the order of association of the control units for various arrangements and modes of the pairs of control units. All clavier switching of control units is done in pairs, primarily to retain the glissando capability, since two control units are required to implement a glissando. The glissando pairs are comprised of the control units 1 and 2, and 3 and 4. In Table 1 a "—" indicates the depression of a new note while the previously depressed note is held. A "," indicates a simultaneous (doubling) association of control units with a common note. "( )" denotes that the busy gate signals and consequent waveform generation associated with the control units enclosed in parantheses are suppressed.

The lockout circuitry is also provided with three additional controls. The block inhibit control can be used to

TABLE 1

Status of the control units for various modes of the instrument.

| MODE | PAIR CONTROL SIGNAL | CONTROL UNIT PRIORITY SEQUENCE |
|---|---|---|
| 4 notes on 1 clavier | Assertion | 1-3-2-4 |
| 2 notes doubled | Assertion | 1,3-2,4 |
| 2 note glissando | Assertion | 1-3-(2-4) |
| 1 note doubled and glissed | Assertion | 1,3-(2,4) |
| 2 notes on 1 clavier, pair $\alpha$ | Negation | 1-2 |
| 2 notes on 1 clavier, pair $\beta$ | Negation | 3-4 |
| 1 note doubled, pair $\alpha$ | Negation | 1,2 |
| 1 note doubled, pair $\beta$ | Negation | 3,4 |
| 1 note glissando, pair $\alpha$ | Negation | 1-(2) |
| 1 note glissando, pair $\beta$ | Negation | 3-(4) |

prevent the startup of all four control units associated with the block to which it is applied, and only these. The lower priority control is connected to the higher priority control of a second block, i.e., group of 4 control units, and permits the expansion of the number of control units in blocks of 4. An indefinite number of blocks can, thus, be cascaded to achieve a higher note plurality, while retaining an overall fixed priority of all control units of all blocks. The block coupling control is used for doubling purposes, since different blocks will service a common note if the blocks are decoupled by making the block coupling control assertive.

FIG. 11 is a logic diagram of the demand circuitry. Assume first that the pair coupling control signal is a negation. Then a demand signal appears for control units 1 and 2 if and only if both (control unit 1 is idle or there is no equality of addresses stored and interrogated in this control unit or doubling of pair $\alpha$ is required) and (control unit 2 is idle or there is no equality of addresses stored and interrogated in this control unit). Likewise, for control units 3 and 4. (Substitute 3 for 1 and 4 for 2 in the preceding sentence.) If the pair coupling control is assertive, then a demand signal appears if and only if (control unit 1 is idle or there is no equality of addresses stored and interrogated in this control unit or doubling of pair $\alpha$ is required) and (control unit 2 is idle or there is no equality of addresses stored and interrogated in this control unit) and (control unit 3 is idle or there is no equality of addresses stored and interrogated in this control unit or doubling of pair $\beta$ is is required) and (control unit 4 is idle or there is no equality of addresses stored and interrogated in this control unit).

FIG. 12 displays the lockout circuits for 4 control units. The multiplexers 220 and 225 merely serve as a four pole, double throw switch the position of which is determined by the pair coupling signal. The pair coupling signal then merely interchanges the control units 2 and 3. The four outputs of the lockout circuitry are gated by NOR gates 226, 227, 228, and 229, which serve as logical AND gates because of the negative logic applied to the inputs (De Morgan's theorem). The negation of the ready signal is used as the gating signal for all 4 lockout outputs. Let us assume that the four pole, double throw switch is so thrown that control unit 2 is connected to gate 230, control unit 3 is connected to gate 223, which imply that gate 230 is in turn connected to gate 227 and gate 223 is connected to gate 228. (Throwing the switch the other way by the pair coupling control signal would merely interchange the order of control units 2 and 3.)

Lockout 1 is assertive if both the ready signal is assertive and control unit 1 is idle. Lockout 2 is assertive if the ready signal is assertive, control unit 1 is busy, and control unit 2 is idle. If the pair coupling control signal is assertive, then lockout 3 is assertive if the ready signal is assertive, control unit 1 is busy, control unit 2 is busy, and control unit 3 is idle. If the pair coupling control signal is a negation, then lockout 3 is assertive if merely the ready signal is assertive and control unit 3 is idle, quite independent of the status of control units 1 and 2. If the pair coupling control signal is assertive, then lockout 4 is assertive if the ready signal is assertive, control unit 1 is busy, control unit 2 is busy, control unit 3 is busy, and control unit 4 is idle. If the pair coupling control signal is a negation, then lockout 4 is assertive if merely the ready signal is assertive, control unit 3 is busy, and control unit 4 is idle.

FIG. 13 displays the stacking circuitry. If the higher priority control signal is a negation, all control units of higher priority are busy and not available for attending further depressed notes. If the higher priority control signal is an assertion, at least one control unit of higher priority is idle and ready to attend a newly depressed note. In this case, no control unit of lower priority can be pressed into the busy state, unless the block coupling control is an assertion, in which case all lockouts of this block act independently of those in the higher blocks. If the block inhibit control signal is an assertion, this block is prevented from using any control unit within the block for attending a newly depressed note, regardless of the need therefor, unless, again, the block coupling control is an assertion, in which case all lockouts of this block act independently of those in higher blocks, as previously. If this block inhibit control signal is a negation, the block is enabled and any control unit within it may be used to attend a depressed note when called upon when idle, and all control units of higher priority are busy. If the block coupling control is assertive, all control units within the block are independent of all others, a feature that may be used to create doubling of notes. The ready signal is an assertion if the block coupling signal is assertive or if both the higher priority control signal is a negation and the block inhibit signal is a negation. The lower priority control signal is an assertion and lower order control units are prevented from attending depressed notes if the higher priority control signal is an assertion or if the block coupling control signal is a negation, the block inhibit signal is a negation, and at least one lockout is assertive, which implies that at least one control unit in the block of interest is in the idle-ready status and prepared to attend the next note newly depressed. The lower priority control of the block of interest is connected to the higher priority control of the block of next lower priority. Likewise, the higher priority control of the block of interest is connected to the lower priority control of the block of next higher priority.

FIG. 14 displays one control unit of a pair. The latch 1 stores the address of the note being served by the associated control unit. The binary address stored in the latch 1 is continuously compared with the running address generated by the binary counters 202 and 203 in the scanner by the comparator 2. The clock drives the strobe input (cascading equal input) to the comparator 2, which permits an equality to occur only during the second half of a clock cycle. The address of a control unit stored in the latch 1 is changed only when a control unit is associated with a new note and the change is caused by an assertion at the output of the startup gate 8, which is applied to the enable input to the latch 1. A control unit is started up if the read pair signal is assertive, which implies that a note is depressed, there is a demand signal, which implies that there is no other control unit attending this note, and the lockout signal for this control unit is assertive, which means that this unit has top priority for the startup, all others of higher priority already being busy. These three signals are applied to the AND gate 8.

At the startup of a control unit, the address on the address lines is read into the latch 1, and the output of this latch 1 is compared with the binary address lines causing an assertion to appear at the output of the comparator 2 during the second half of the clock cycle. This equality signal is applied to the clock input of the edge-triggered disconnect flip flop 5, and would cause the negation output $\overline{Q}$ of this flip flop to go OFF were not the startup gate signal applied to the clear input of the disconnect flip flop 5 via the NOR gate 3. The clear input signal overrides the clock signal, and the negation output $\overline{Q}$ is assertive. No further change in the status of the control unit takes place until the reset signal applied to the clock input of the delay D type flip flop 6, which is also edge triggered, becomes assertive, at which time the assertion from the disconnect flip flop 5 is clocked into the delay flip flop 6. Since the read pair and reset pulses originate from a pair of sequentially driven univibrators 212 and 213, the read pair signal is OFF when the reset signal in ON. The assertive output Q of the delay flip flop 6 and the equality signal from the comparator 2 drive the input AND gate 126, if the control unit is associated with the odd member of the pair $\alpha$ of the demand signal generator. The negation of the double read pair signal also drives this input AND gate 126. The equality signal and the Q output of the delay flip flop of the control unit associated with the even member of the pair $\alpha$ drive AND gate 127 of the demand generator. The busy signal now in the delay flip flop 6 is clocked into the busy-idle JK type flip flop 7 when the clock signal becomes a negation, at which time the interrogation of a new note has begun. Thus, the busy condition of a control unit associated with a particular note does not appear at the busy-idle flip flop 7 until the interrogation of the next note has begun. This condition of the note being attended must be implemented before the control unit removes itself from the lockout list; otherwise, the demand signal would still be ON when a new control unit assumes priority on the lockout list, and a second control unit would start up and become associated with the note. Indeed, the double pair read signal prevents a demand assertion at the output of the demand generator from being turned OFF, so that on the next scan of the clavier the demand signal will still be ON when the same depressed note is interrogated, a second control unit with its tone generator will associate itself with the note, leading to a doubling of generators on this note, as is sometimes desirable. In any event, this second control unit suppresses the demand output.

On the next scan of the clavier, when the depressed note of interest is interrogated by the scanner, there will be no startup signal from the startup gate 8, there will be an equality assertion from the comparator 2 on the second part of the clock cycle, the read pair α signal will be assertive, the busy-idle flip flop will indicate a busy status, which implies that the negation output of this flip flop will be a negation, the continue signal will be an assertion and the clear signal will again override the equality assertion applied to the clock input of the disconnect flip flop 5. The assertion of the negation output $\overline{Q}$ of the disconnect flip flop 5 will be clocked into the delay flip flop be the reset signal, and this assertion will be clocked into the busy-idle flip flop 7 at the start of the new clock cycle, leaving this flip flop 7 unchanged in status.

On the first interrogation of the note just after it is released, the equality output from the comparator 2 on the second part of the clock cycle will cause the negation output $\overline{Q}$ of the disconnect flip flop 5 to be a negation, the read pair signal having become a negation, the continue signal also having become a negation, and the startup signal being a negation, of course. This negation from the disconnect flip flop 5 is clocked into the delay flip flop 6 by the reset signal, and eventually clocked into the idly-busy flip flop 7 at the start of the next clock cycle and interrogation of the next note.

FIG. 15 is a block diagram of the strobe and equality circuits. A logical OR is computed among all the equality signals in the instrument, including the tuned percussion control units, if present. Thus, if any equality signal appears in any control unit in the instrument, a univibrator 341 creates a (2 μsec) equality signal the trailing edge of which triggers the frequency modulation strobe univibrator 211 that provides the equal and opposite strobe pulses to lines 430 and 431 to measure the vibrato applied to the notes. This equality signal can occur either during the period a note is depressed or after. The latter condition is especially important for tuned percussive sounds, because a sostenuto may be associated with them so that the note continues sounding even after it has been released.

The trailing edge of univibrator 341 also triggers a second univibrator 342 that creates a (3 μsec) strobe pulse. This pulse is used to cause various sample and hold gates to sample their respective signals, these gates being in the sound generator common. The delay created by the equality univibrator 341 eliminates the effect of settling transients in the digital-to-analog convertor 204, the voltage-controlled oscillator sampling gates, such as those shown in FIGS, 16 and 17, the force decoder 208, and the frequency modulation decoder 209.

FIG. 16 is a block diagram of the sound generator common system. This system generates a variety of signals that are used in common by a large number of sound generators 114. The equality signal generated in a corresponding comparator 2 is ANDed together with the strobe signal 343 to indicate the moment in time at which the output of the digital-to-analog convertor must be sampled. The outputs of the frequency sample and holds, such as 432 and 433, of a pair drive a glissando variable resistor, such as 444. The glissando variable resistor, such as 444, is driven also by two glissando voltage-controlled oscillators, such as 438 and 445. The glissando voltage-controlled oscillators are controlled by the outputs of the force sample and hold circuits, such as 442. The force sample and hold circuits are driven by the read pair signals and the logical AND between the corresponding equality signal and the strobe signal. The output of the glissando variable resistor drives the voltage-controlled oscillator, such as 439, associated with the odd member of each pair. The force of depression determines the frequency of oscillation of the associated glissando voltage-controlled oscillator. The frequency of this oscillator, such as 438, determines the coupling resistance of the output of the frequency sample and hold circuit, such as 432, to the output circuit of the glissando variable resistor, such as 444, as will be explained later. Thus, the output potential of the glissando variable resistor is the linearly interpolated value (based on the forces of depression of the two notes forming the lowest and highest notes involved in the glissando) between the potentials of the two frequency sample and hold circuits, such as 432 and 433. Thus, the frequency of the voltage-controlled oscillator associated with the odd member in each pair of control units is intermediate between the frequency of the two notes defining the limits of the glissando. The voltage-controlled oscillator, such as 446, associated with the even member of each pair is driven directly by the output of its associated frequency sample and hold unit, such as 433. In the nonglissando mode, the output of the odd frequency sample and hold unit, such as 432, in each pair is effectively connected directly to its voltage-controlled oscillator, such as 439. The output of the force sample and hold circuits, such as 442, is differentiated by a differentiator, such as 450, to produce a signal proportional to the speed with which a note is being depressed. The gate inputs for the speed determining circuits are shown in FIGS. 24 and 25 for the odd and even control units, respectively, in each pair. Thus, the gate 1 input to speed circuit 450 is shown in FIG. 24 to involve the sustain, control unit 1 busy, control unit 2 busy, and glissando for pair α signals, in fact. The gate 2 input to the speed circuit 452 is shown in FIG. 25 to involve the sustain, control unit 2 busy, and glissando for pair α signals. Gate 3, which is the input to speed circuit 453, and gate 4, which is the input to speed circuit 455, are associated with pair β, the glissando circuits for pair β, and the control units 3 and 4 busy signals, the circuits of which are identical with those of FIGS. 24 and 25 with appropriate changes of input and output associations. A circuit, such as 451, determines which force of the two forces of note depression of each pair involved in a glissando is the greater. This circuit is shown in FIG. 19 and will be explained shortly. Circuits, such as 436, sample and hold the vibrato signals from the two notes associated with each pair. These circuits are shown in FIG. 20 and will also be explained shortly. Gating signals are provided from the frequency sample and hold circuits and the force sample and hold circuits to the vibrato sample and hold circuits, as will be seen shortly.

FIG. 17 is a schematic diagram of the frequency sample and hold. A nongating terminal of a field effect transistor Q8 is attached to the output 312 of the digital-to-analog convertor 204; the other nongating terminal is attached to a holding capacitor C3 and to the input of an operational amplifier connected as a voltage follower. The gating terminal of the field effect transistor Q8 is connected to the AND between the equality signal created by the comparator 2 of the associated control unit and the strobe signal 343, the amplifiers A6 and A7 having open collector outputs. The strobe signal 343 appears at a time when the output of the digital-to-analog convertor has settled to 0.1% of its final value. The capacitor C3 holds the sampled potential between successive scans and may be inexpensive since it need not hold this potential any longer, whether the note is depressed or not, since the control unit remembers the address of the last note with which it was associated. Likewise, the unity gain connected operational amplifier A8 can be inexpensive for the same reason.

FIG. 18 is a schematic diagram of the sample and hold for the force for pair α. Pair α is associated with one of the claviers. Accordingly, the read pair α signal for each clavier is used to gate the force signal presented by each clavier through a field effect transistor specific to that clavier to an output line common to all claviers. The signal on this common line is gated by the frequency sample and hold gating signal (AND of the strobe and equality signal for the specific control unit) into a holding capacitor specific to the control unit by means of another field effect transistor. Thus, the read pair α, the strobe, and the address equality signals are ANDed together to determine the moment of sampling of the force signal. The output of the field effect sampling transistor is also connected to the input of an operational amplifier used as a voltage follower.

FIG. 19 is a schematic diagram of a circuit that selects the greater of two force signals for its output. This mode is used when the instrument is in the glissando mode. When it is desired that the output be equal to the greater of the two force signals applied to the bases of the emitter followers, Q9 and Q10, the gating signal of the field effect transistor biases this transistor to the conducting state. The output then is the larger of the two signals at the emitters, and thus the bases of the transistors Q9 and Q10. The emitter of the transistor Q9 or Q10 connected to the base at the lower potential is back biased and rises to the potential of the emitter of the transistor connected to the base at the higher potential.

FIG. 20 is a schematic diagram of the vibrato sample and hold for pair α including the transfer circuitry from the even member to the odd member in the glissando mode. The signal used to gate the force sampling for a particular clavier and pair is also used to gate the vibrato sampling for that particular clavier and pair. The vibrato signal for each clavier is, thus, gated to a common output line, as with the force; the signal on this common output line is sampled by a second set of field effect transistors and held in suitable capacitors. This gate signal is that used to simultaneously gate the potential corresponding to the note associated with this vibrato signal, the particular pair involved, and the control unit. The sampled signals are capacitively and resistively coupled to an operational amplifier.

The output amplifier is essentially a low-pass filter (0.01 sec time constant) with gain to reject noise. Since a frequency of vibrato is subaudio, the cutoff frequency of the filter may be in the low part of the audio band so that it will reject great amounts of noise. The field effect transistor Q21 serves to connect the inputs to the two amplifiers A9 and A10 together if and only if pair α is to be a glissando pair and when the second control unit is busy. Thus, as will soon become apparent, during a glissando, the odd control unit of a pair is associated with the first note depressed and the even control unit is associated with the second note depressed. The field effect transistor Q21 serves to mix the vibrato signal created by the second note into the first sound generator, via the vibrato sample and hold amplifier associated with the first note if and only if the pair is to be a glissando pair and when the second unit is busy, i.e., after the second note has been depressed in the glissando pair. Thus, when only the first note is depressed, it solely determines the vibrato; when both the first and second notes are depressed, the average sidewise motion of both keys controls the vibrato created; and, when only the second note remains depressed, it solely determines the vibrato.

The transistor Q18 serves to restore the output of the coupling capacitor C4 to the reference potential when a negation appears at the output of the OR gate 804. This output will be an assertion whenever either the first control unit is busy or pair α is not in the glissando mode or control unit 2 is idle. Thus, the restored condition appears if and only if the first control unit is idle, the second one is busy, and the clavier is in the glissando mode. Thus, the input potential to the amplifier A9 is independent of the vagaries of the potential remaining on the coupling capacitor C4. An analogous situation takes place with the vibrato sample and hold unit for control unit 2 and for both control units of pair β. The capacitor C10 and resistor R13, for example, provide a time constant in the order of 0.4 sec for the removal or application of the reference potential. This feature presents striking a note out of tune initially and yet permits a vibrato to be created in the traditional manner, viz., initially nonexistent, growing in magnitude with time, and finally stabilizing more or less to a fixed amplitude of frequency modulation.

Figure 21:
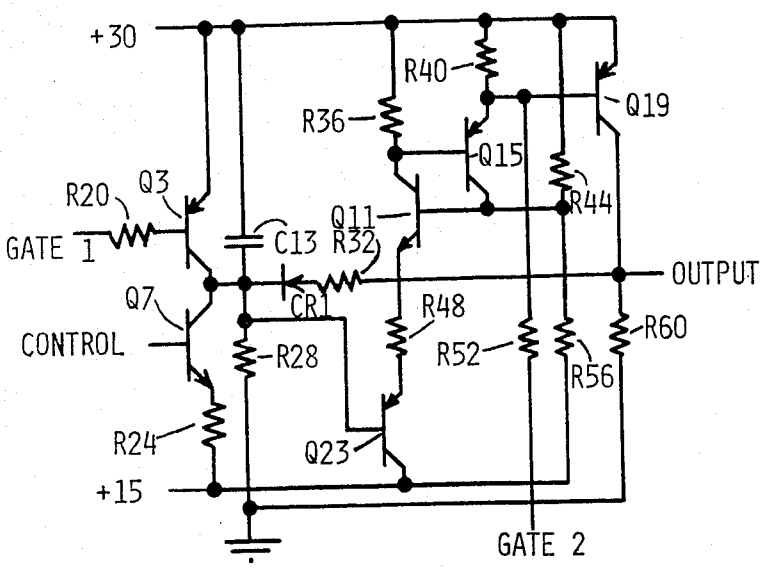
FIG. 21 is a schematic diagram of the circuit for a voltage-controlled oscillator that is responsive to the force with which a note is depressed.

FIG. 21 is a schematic diagram of the force controlled oscillator that is used in connection with creating the glissando. For this reason, these oscillators are called glissando, voltage-controlled oscillators. These oscillators are controlled by the force signals from the force sample and hold circuits 442 and 443 in FIG. 16 and by gating signals. If the pair α is in the glissando mode, then if either control unit 1 or control unit 2 is busy, but not both, these gates cause the outputs of the glissando voltage-controlled oscillators to be static and at a potential appropriate to the depressed note associated with the busy control unit. As soon as two notes are depressed, both glissando, voltage-controlled oscillators run at a frequency determined by the respective force signals (somewhere between 10 kHz and 1.5 MHz).

A glissando voltage-controlled oscillator has three meaningful states:

| STATE | GATE 1 | GATE 2 | OUTPUT |
|---|---|---|---|
| ON | Irrelevant | Low | High |
| OFF | Low | High | Low |
| RUN | High | High | Intermediate |

If the gate 2 is low (0 volts), the output transistor Q19 is held ON, and the output is high (30 volts). If gate 2 is high and gate 1 is low, transistor Q3 is held ON, allowing the emitter of Q23 to go high. Q19 is held OFF; thus, the output is low.

The glissando, voltage-controlled oscillator is in the RUN state if both gates 1 and 2 are high. Consider the case where the control input is low. Transistor Q7 is thereby biased OFF and no collector current flows. Also, assume that the potential across capacitor C13 is 0 so that the potential at the collectors of transistors Q3 and Q7 is high (30 volts). Transistor Q23 will then be biased OFF. The voltage dividing resistors R44 and R56 provide a potential of about 24 volts to the base of transistor Q11. As long as the potential at the emitter is greater than about 24 volts, transistor Q11 is back biased; no current flows in the collector of this transistor; the base and emitter of Q15 are at 30 volts; no current flows in the collector of this transistor Q15 either. The emitter and base of the transistor Q19 are also at 30 volts, so no current flows through this transistor either from emitter to collector, so the output potential is 0 volts, low.

Current, however, does flow through the resistor R28 causing the potentials at the base and emitter of transistor Q23 and emitter of transistor Q11 to fall. When the potential at the emitter of transistor Q11 reaches approximately 24 volts; this transistor Q11 starts to conduct, which causes transistor Q15 to start to conduct also, thereby raising the potential at the base of transistor Q11, which causes this transistor Q11 and the transistor Q15 to conduct all the harder. These two transistors are regeneratively connected. The potential at the base of transistor Q19 drops; transistor Q19 conducts; the potential at the output rises to 30 volts all quite suddenly. The resistor R32 and diode CR1 pull up the potential at the collectors of transistors Q3 and Q7, and the base of transistor Q23, decreasing the potential across capacitor C13. The potentials of the base and emitter of transistor Q23 then rise eventually to almost 30 volts, turning OFF the current flowing through the transistors Q11 and Q15, at which point the potential at the base of transistor Q11 returns to about 24 volts, and the cycle repeats again.

The resistor R28 is quite large and provides the current to run the oscillator at its lowest frequency, which occurs when the control input is at 0 volts, as assumed above. This potential is correlative to the minimum force of depression on the note. As the force on the note is increased, the potential at the control input increases; the transistor Q7 supplies a current approximately proportional to the control potential. (Note that the emitter potential tracks that of the base of the transistor Q7 so that the potential across the resistor R24 approximately tracks that of the base so the current through the collector of this transistor is approximately proportional to the base potential, i.e., the control potential.) Thus, as the control potential is increased the discharge rate of the capacitor C13 is increased, thus decreasing the time required to reduce the potential at the base of the transistor Q23 and trigger the change of state of the regeneratively coupled transistors Q11 and Q15, thus decreasing the period and increasing the frequency of the glissando voltage-controlled oscillator.

FIG. 22 is the schematic circuit of the duty-cycle-controlled resistance bridge. The glissando, voltage-controlled oscillator outputs are applied to the gates of the field effect transistors Q27 and Q29. The 0 to 30 volt swing applied to these transistors turns them fully ON and OFF. The ON time of the oscillator signals is approximately constant, but the frequency is increased when the force of depression of a note is increased, and this increases the conductance of the resistor-R64-transistor-Q27 leg as the frequency of the oscillator applied to this leg is increased. The resistor R64 and capacitor C17 form a low-pass filter that prevents the switching spikes of the field effect transistor Q27 from reaching the operational amplifier A8 that is a voltage follower on the output of the capacitor that holds the potential corresponding to the frequency. The resistor R66 and capacitor C19 perform a similar function with respect to the field effect transistor Q29 and the voltage-follower operational amplifier connected to the input 2. The low-pass filter 121 consists of a $\pi$ type RC filter and smooths the output of the resistance bridge. Thus, the frequency of the glissando, voltage-controlled oscillator must be such that the oscillator is easy to make, must be sufficiently high that its output can be readily filtered, yet sufficiently low to not exceed the switching speed of the field effect transistors. A frequency range of 10 kHz to 1.5 MHz has been found suitable. The low-pass filter must have a high enough cutoff frequency that the slewing rate at the output is sufficient for a glissando.

FIG. 23 is a schematic diagram of the voltage-controlled oscillator. It is basically a conventional precision sawtooth generator, i.e., an operational amplifier integrator. Resistor R70 determines the current to be integrated. Capacitor C25 must have low dielectric adsorption and a low temperature coefficient, such as polycarbonate. Comparison amplifier A23 senses the output potential of the integration amplifier A19. When this potential reaches the reference potential plus a perturbing potential, the output of amplifier A23 goes negative, turning ON transistor Q35, which turns ON the field effect transistor Q31 via resistor R90. The perturbing potential is applied to the amplifier A23 via the capacitor C33 and resistor R102. The comparator amplifier A23 is regeneratively connected via the capacitor C29, and, when this comparator triggers, the collector of transistor Q35 goes positive pulling the negative input of the comparator amplifier positive via capacitor C29. This capacitor discharges via R98 while the capacitor C25 is also discharging. The comparator A23 output resets to a positive potential, turns OFF transistor Q35 when the capacitor C29 has discharged to the value appearing at the positive input. The cycle then repeats.

The reset time is determined primarily by the resistor R98 and the capacitor C29, and is set to about 20 $\mu$sec. If the potential traversed by the integrator were precisely the same, regardless of the potential applied at the control input, this 20 $\mu$sec interval would cause the relation between potential and frequency to be nonlinear. However, it should be noted that when the capacitor C25 is discharged, the output of the integrator amplifier A19 does not reset precisely to 15 volts (the summing point potential), but rather to a potential less than 15 volts by an amount proportional to the input potential applied to the control input. This reset potential is determined by the input potential applied to the control input and the ratio of the resistances of resistor R70 and the resistance of the field effect transistor Q31 in the conducting state and the resistor R82. By choosing the appropriate value for resistor R82, the effect of the dead time can be exactly cancelled to provide a linear relation between the control potential and the frequency generated. Variation of the resistance of resistor R82 from this particular value can be used to give slightly compressed or expanded potential-frequency characteristics, as is desirable in creating a Railsbeck stretched scale.

FIG. 24 is a schematic diagram of the circuit used to generate an output potential proportional to the greatest value of the derivative of the force signal during the interval for which the input to resistor R134 is 5 volts. (If this gating input is 0 volts, the circuit is inactive.) This circuit is just a low-pass filter driving a diode-capacitor peak detector. A field effect transistor serves to switch the diode of the peak detector. A source follower provides the output circuit. Negative feedback assures linearity and freedom from component variations. The resistor R114 and capacitor C37 at the input for the force signal form a low-pass filter with a cutoff of approximately 350 Hz to eliminate the noise that results from the sampling of the force function at approximately 10 kHz, the frequency at which the scanner sweeps the claviers. Transistor Q39 and resistor R118 comprise an emitter follower.

If the potential at the input to the resistor R134 is 0 volts, the transistor Q55 is then OFF, and the field effect transistor Q51 is ON. The output of the amplifier A27 is then transmitted through the field effect transistor Q51, the follower circuit comprised of the transistors Q59 and Q63, and resistors R138 and R142. The field effect transistor Q59 is a depletion type with the source being more positive than the gate. If no alternating current signal is present at the capacitor C41 and the operational amplifier A27 is ideal, the output will be 15 volts, the feedback loop being completed through the resistor R126. In this state the diode Q43 is reversed biased.

If the potential at the input to the resistor R134 is 5 volts, the transistor Q55 turns ON, the field effect transistor Q51 turns OFF. Any current to the operational amplifier via capacitor C41 and the resistor R122 must be matched with the feedback current through either the diode Q43 or the resistor R126. If the force is positive going, the current will flow through diode Q47 charging the capacitor C45. As soon as the current to the operational amplifier A27 via the capacitor C41 starts to decrease, the operational amplifier will attempt to pull its output more positive, which will back bias the diode Q47. The potential across the capacitor C45 at this instant is a minimum and will remain at this value until the input current to the operational amplifier A27 exceeds the previous maximum value, so long as the field effect transistor Q51 is OFF, i.e., nonconducting. As the operational amplifier A27 output continues to go positive, diode Q43 begins to conduct, having been back biased up to this point. Thus, any input current to the operational amplifier A27 less than the maximum value is supplied by diode Q43. The resistor R122 is used to roll-off the gain of the differentiating circuit above about 400 Hz.

The gating circuit applied to resistor R134 in FIG. 24 is that appropriate to the odd member of each pair. The gating signal applied to this resistor R134 is an assertion (5 volts) if the even control unit is busy and the instrument is in the glissando mode, or if the odd control unit is busy, or if the sostenuto signal is assertive, or becomes assertive at any time the odd control unit is busy, even if this control unit becomes idle, so long as and only so long as the sostenuto signal remains assertive or the odd control unit remains busy.

The gating circuit appropriate to the second member of each pair for application of the gating signal to the input resistor R134 is shown in FIG. 25. The gating signal applied to R134 is not an assertion in this case if the instrument is in the glissando mode, and the even control unit is busy, or the sostenuto signal becomes assertive at any time the even control unit is busy, even if this even control later becomes idle, so long as and only so long as the sostenuto signal remains assertive or the even control unit remains busy.

FIG. 26 is a schematic diagram of the multistate switch and the display used in the musical instrument. Each switch and its associated lamp, which is preferably a light emitting diode, are preferably located in juxtaposition. whenever a switch is depressed, any other lamps interconnected to the same set of gates go OFF and the lamp associated with the newly depressed switch goes ON. The gates 701, 702, and 703 are interconnected in a multiflop configuration, so that only one gate can be ON at a time. This goal is accomplished by interconnecting NAND gates, n NAND gates each having N−1 inputs are required for a generalized n position "switch". The light emitting diodes 704, 705, and 706 can be driven directly from standard transistor-transistor logic, where the resistor 707 is used to limit the current through the diode that is in the conducting state. Only a single resistor need be used since only one diode is ON at any given time. The switches 708, 709, and 710 are inexpensive momentary contact switches, which merely short the output of the relevant gate to ground, i.e., 0 volts. Substantial current flows at the instant the switch is closed, removing the requirement for expensive contact material. Even if the switch contacts bounce badly, a single conduction period of several nsec is adequate to cause the circuit to change state reliably. The advantages to this scheme are as follows: (1) Only a single wire from the logic to a switch panel is required for each position, in addition to the ground and power supply leads. (2) Only a single resistor is required for all the light emitting diodes associated with the poles of one multiposition switch. (3) The switching is accomplished by shunting current to ground; thus, no power is present on the movable switch contact 708, 709, or 710. (4) Switch bounce presents no problem. (5) Substantial current flows momentarily eliminating the need for expensive contact material. (6) No lamp buffer amplifier is required. (7) Small lamps can be used, allowing close contact point spacing. (8) The circuit is emenable to integration. (9) Simultaneous depression of more than one contact causes no problem; the single current limiting resistor minimizes the power dissipation in each integrated circuit package, if more than one switch is depressed. The switch remembers which contact is held the longest without ambiguity.

FIG. 27 is a schematic diagram of the French horn tone generator together with circuits for translating the horn generator up or down by an octave, circuitry for controlling the intensity and spectral envelope of the signal generated. If this sound generator is to create a pp tone, then the pp control line is assertive, i.e., 20 volts, and the resistor R46 is shorted out, thereby decreasing the gain of the amplifier A15. Likewise, if the sound generator is to create a ff tone, then the ff control line is assertive, i.e., 5 volts, and the resistor R47 is connected to +15 volts, thereby increasing the gain of the amplifier A15. A mf tone is created when both the pp and ff control lines are negations, i.e., at 15 volts.

Sound generator common 110 provides the force signals, the ungated pitch pulses and the gating signals. The gating signals are provided by the output of the NAND gate 242 or NOR gate 246 of FIGS. 24 and 25 for the tone generator associated with the odd and even members of each pair, respectively, and applied to one of the NAND gate 541 inputs. The ungated pitch pulses are applied to the clock input of the divider flip flop 545, which provides a signal to the multiplexer 543 at ½ the frequency of the ungated pitch pulses; the assertion output of the flip flop 545 drives the clock input of the flip flop 546, which provides a signal at ¼ the frequency of the ungated pitch pulses to the multiplexer 543, the flip flops 545 and 546 forming a binary counter. These pulses to the gate 542 are suppressed if either the relevant pair is not associated with the relevant clavier or the clavier is OFF. The ungated pitch pulses after passing through the logical NAND gate 542 (a physical NOR gate because of negative logic at this point), are applied to the open collector NAND gate 541 together with the output of the NAND gate 242 or NOR gate 246. This latter signal is a gating signal for the pitch pulses and provides gated pitch pulses to the input of resistor R49. Thus, gated pitch pulses appear only if a note is depressed or has been depressed sometime when the sostenuto is assertive and the sostenuto is still assertive.

The force signal is applied to the circuitry associated with the amplifiers A16 and A12. Resistors R25, R26, and R27, capacitors C14 and C15, and amplifier A16 comprise a bandpass filter with a Q of 5 and a resonant frequency of 50 Hz. This filter is a burple generator that causes pulse width modulation by means of the comparator A12. Slow changes less than 10 Hz in frequency of the force signal cause pulse width modulation by way of the resistor R29. A short, 4 $\mu$sec long repetitive pitch pulse turns ON the transistor Q32, shunting the capacitor C21 to ground. Transistor Q32 then turns OFF, allowing the potential across capacitor C21 to rise, current being supplied through the resistor R83. The time required for the potentials applied to the amplifier A12 to become equal depends on the magnitude of the force signal, the time constant of R83 and C21, and the output of amplifier A16. Thus, the width of the pulse generated is proportional to these factors. This variable width pulse then turns transistor Q28 ON and OFF by way of the bias coupling network comprised of resistors R33 and R34.

The gated pitch pulse is applied to the network comprised of the resistors R41 and R49, and the capacitor C22; this network creates the envelope of the output waveform, as described in patent application Ser. No. 146,514, dated June 1, 1971. Transistors Q33 and Q37 comprise a Darlington connected emitter follower of which the output is the envelope function. The signal at the collector of transistor Q28 is, thus, a pulse which is pulse height modulated by the envelope function and pulse width modulated by the force signal and the output of the burple generator. This width-height modulated signal is applied to the filter comprised of resistor R35 and capacitor C20, and then to the formant filter comprised of resistors R37, R38, R42, and capacitors C16 and C18. The current through resistor R42 is a peaked, low-pass signal with a formant resonance of about 450 Hz. The amplifier 15 and associated feedback elements provides an output potential proportional to the current applied to its input.

If the intensity for the relevant pair is mf, then the field effect transistors Q30 and Q36 are OFF, and the feedback resistance is the sum of R43 and R46. In the pp state, Q30 is ON and Q36 is OFF, and the feedback resistance is R43. In the ff state, Q30 is OFF and Q36 is ON, giving a higher feedback resistance. This particular mode of changing gain states is used because it minimizes the problem of passing through a feedback situation that might cause irregular output levels. This situation is especially true if the drive signals fed to the field effect transistors Q30 and Q36 are slowed down to prevent clicks in the output signal if a change of the gain is made during the depression of a note. The diode Q34 causes the tone color to change with intensity. Note that a static path can be traced from the resistor R32 to which the ungated pitch pulses are applied to the final output. The diode clips the output waveform, thereby introducing higher spectral components as the intensity increases, either as a result of the intensity set on the controls or by way of the force signal that causes pulse width modulation and thereby level changes.

The components primarily determining each function are shown in Table 2.

TABLE 2

Function of various components.

| FUNCTION | PRIMARILY DETERMINED BY |
|---|---|
| Burple amplitude | R26 |
| Burple frequency | R27 |
| Gain scaling | R83 |
| Attack duration | R49 |
| Decay duration | R41 |
| Formant frequency | R42; changes output intensity Readjust R43, R46, R47 to compensate |

Relative intensities of pp, mf, ff R43, R46, R47, respectively

The manually switched ensemble control 231 and solo control 232 signals switch the field effect transistors Q72, Q73, Q74, and Q75 ON and OFF. These transistors, in turn, switch the four French horn tone generators to various speaker systems, such as the first or second ensemble or solo, resistors R45, R84, R85, and R87 serving as summing resistors to this end.

The control units for the tuned percussion are different from those for the nonpercussion in two respects: (1) The lockout priority system is based on the time elapsed since a particular lockout entered the busy state, i.e., its age. (2) The startup signal may be overridden by an equality signal. The lockout priority system is different so that the control units activated most recently and, therefore, the most likely to be producing a strong output signal will not be reassigned, i.e., robbed, before control units producing less intense signals. The lockout system is such that the control unit that became busy longest ago is the one having the highest priority if a new demand appears. The equality signal may override the demand signal to eliminate the buildup of different control units associated with the same note, as may otherwise occur by repeatedly striking the same note, for example. The need for this override derives from the introduction of the age priority system in the lockout system. (In a fixed priority system, one gets the same control unit for each repeated striking of the same note.)

FIG. 28 is a block diagram of a control unit for a tuned percussive sound generator. The latch 810 stores the binary address of a note currently being attended or previously attended. The address of the note currently being interrogated is compared with the address of the note stored in the latch 810 by the comparator 815. The read, lockout, and demand signals are ANDed by the gate 820. If a note is found depressed for the first time and if there is no control unit with stored, note address already agreeing with that of the note interrogated presently, then the demand signal will be an assertion. The demand signal selects the oldest lockout element to be idle ready from the idle-reserve group, and the associated control unit is the next one started up. This selected unit will then provide an assertion at the AND gate 820 output; this assertion is applied to the clock input of the latch 810 by way of the OR gate 816. This clock signal causes the address of the note currently being interrogated to be read into the latch 810. The output of OR gate 816 is also applied to the clear input of the D type flip flop 813 through OR gate 811 and causes the negation output $\overline{Q}$ of this flip flop to be an assertion, in the process overriding the equality signal from the comparator 815 applied to the clock input of the flip flop 813. If the clear signal were not an assertion, this equality signal would cause the negation output of the flip flop 813 to be a negation. This flip flop is one that is triggered only on the positive going, leading edges of the signal applied to the clock input. The reset pulse occurs at the end of the read signal and causes the assertion output of the D type flip flop 814 to be an assertion, thus indicating that this particular control unit is busy.

After the control unit has been started as just described via gates 816 and 820, gates 816 and 819 continue the association of the control unit. Upon interrogation of the note with the binary address stored in the latch 810, the equality output of the comparator 815 is assertive; the read signal is assertive also, since we assume that the note is still depressed. The demand signal is OFF, however, being turned OFF by the equality signal by way of the gates 817 and 823. The demand signal is a system signal; any control unit suppresses this signal if an equality appears at the output of its comparator. This situation contrasts with that for the control units associated with the nonpercussive sound generators, where both equality and busy signals were required to suppress the demand signal. This procedure with the percussive control units for the percussive sound generators prevents another sound generator being associated with a particular note and, thus, the association of many control units with that note, each time that note is struck.

Since the equality and read signals are assertive, the negation output of the flip flop 813 remains assertive. It should be noted here that, if there had been a control unit with an address equal to a newly depressed note, then the demand signal would be OFF, and the control unit with the equality would be started up via the gate 811, 816, and 819 path. Gate 819, thus, provides the continue and the start-an-equal-control-unit signal.

The various equality signals are ORed in gates 817, 818, and 821. Gate 822 provides for coupling or decoupling the two groups of control units for percussive sound generators according to the state of the block coupling signal. If this signal is OFF, then the two demand sections are decoupled; an assertion at the output of OR gate 823 or OR gate 824 does not imply an assertion at the output of the other and conversely. If, however, the block coupling signal is ON, then any equal signal in either of the two blocks will cause both demand signals at the outputs of the OR gates 823 and 824 to be assertive. In the instrument constructed, one block had 3 control units in it and the other had 6.

FIG. 29 is a schematic diagram of the run-up circuit. When the tuned percussion busy gate is ON and the associated control unit is busy, and the drive-in signal is OFF (0 volts), transistor Q41, an emitter follower, is OFF, its emitting being essentially at ground potential. Transistor Q40 is turned ON and, therefore, the base of transistor Q38 is near ground and the output is at 0 volts. This potential applied to the lockout element NAND gate in FIG. 30 prevents the lockout from going into the idle-ready status. When the tuned percussion busy gate goes OFF, i.e., when the associated control unit becomes idle, transistor Q40 goes OFF, i.e., becomes nonconducting, and the potential at the base of transistor Q38 begins to rise with a time constant of 1 sec, pulling up the output, so that this output eventually reaches the trigger level of the lockout NAND gate Schmitt trigger, and putting it into the idle-ready state. If the potential at the output is below this trigger point, which is about 1.7 volts, when the drive-up line goes ON to start up a new control unit, the base of transistor Q41 rises with a time constant of 1 μsec and, thereby, the emitter of transistor Q41, which causes a potential to appear at the base of transistor Q38 equal to the sum of the 1 μsec ramp and the 1 sec ramp. Thus, the lockout element input that reaches the trigger point first is the one that has developed the largest potential across the capacitor C23. This is associated with the control unit that has been out of service the longest.

After a sufficiently long time, all run-up circuits have the same output level, making the choice of new control units arbitrary, which is all right, since a long time after a key is released it is all right to reassociate the control unit with a new note.

FIG. 30 is a block diagram of the lockout for the tuned percussion control units belonging to the block with 3 control units in it. The NAND gates 602, 604, and 607 have Schmitt trigger inputs. The basic elements are four input NAND gates cross coupled in the multiflop configuration described earlier. This cross coupling scheme allows one and only one element to go ON, producing a 0 at its output, at a time, for, as soon as one element goes ON, it turns all others OFF, producing a 1 at all their outputs. Two of the NAND gate inputs are used for cross coupling, one is used to cross couple to other lockout sections, in this case to the lockout block associated with 6 control units. The fourth input is used to remove elements from the idle-ready list when the associated control unit goes busy by way of the tuned percussion busy gate lines.

These are three states for the lockout circuit: (1) startup, (2) continue, (3) key released. In the startup case, the read block and demand signals are both ON, i.e., assertive, for reasons explained above. The drive-up signal will then be ON for the outputs of the invertors A17 and A20 are open collectors in a wired AND configuration. The only control units that can be started up are idle; therefore, their associated tuned percussion busy gates are OFF. The run-up circuit creates a ramp that rises with a time constant of 1 μsec. The output of one of the NAND gates 602, 604, or 607 becomes 0, say gate 602 and the lockout output goes ON. The control unit used to attend the newly depressed note is then that associated with this NAND gate 602. When this control unit goes busy, its corresponding tuned percussion busy gate becomes assertive, the demand signal goes OFF, and the drive-up signal goes OFF, changing the output of the run-up 1 601 to a 0, which turns OFF NAND gate 602 and turns ON another lockout element, in this case either NAND gate 604 or NAND gate 607.

In the continue state, the control unit and depressed note continue the previously established association. The tuned percussion gate remains ON, the demand signal remains OFF, the read block signal remains ON, and the drive-up signal remains OFF. The output of run-up 1 601 also remains OFF; the NAND gate 602 output is ON and the lockout is OFF, indicating that the present control unit need not be restarted, and forcing some other control unit into the idle-ready status to be prepared for next note that is newly depressed.

In the note release state, the tuned percussion busy gate goes from ON to OFF, the demand remains OFF, the read block signal is OFF, the drive-up signal remains OFF. The run-up circuit, however, creates a slowly rising ramp with a time constant of 1 sec. There is a reason for this slowly rising ramp. As explained earlier, this slowly rising ramp is added to the rapidly rising ramp present when a new note is to be started up.

The potential reached by the long ramp is proportional to the time since the last note associated with it was released, the potential being held to be 0 so long as the control unit was busy with the previously depressed note. Thus, if several control units are not busy, the first one to be selected for attending the next note depressed and put into the idle-ready state is that associated with the ramp having the greatest potential for the output of this run-up circuit will reach the trigger threshold of the associated NAND gate with Schmitt-trigger input before any other run-up will reach the threshold of its associated NAND gate with Schmitt trigger input. This NAND gate output will be turned OFF and the associated lockout turned ON.

Suppose, now that all control units are busy, which implies that all tuned percussion busy gates are ON and that the outputs of all run-up circuits are OFF. No note is released, and another is depressed. The read block and demand signals both go ON, the drive-up signal goes ON, the outputs of all run-up circuits start increasing rapidly (1 μsec time constant) toward $V_{cc}$ (5 volts). Eventually the output of one of the NAND gates 602, 604, or 607 goes OFF, its lockout goes ON, thus disassociating one of the units from its old note and reassociating it with the new note.

FIG. 31 is a schematic diagram of the sound generator common system for the tuned percussion tone colors. It is substantially identical to the sound generator common system for the nonpercussion tone colors with the omission of the vibrato and glissando circuits. (These omissions need not be made, unless it is desired to keep the cost as low as possible.) Thus, a wired AND of the tuned percussion equality control unit signal and the strobe signal 343 establishes the moment of sampling of the digital-to-analog convertor output by means of the field effect transistors Q42 and Q44, the samples being held between one scan and the next of the clavier in the sampling capacitors C26 and C27. A voltage follower A25 or A29 for each of these capacitors buffers them and excites the frequency control input of the voltage-controlled oscillator 910 or 911. The block read signals for all the claviers gate the force signals, if any, from all claviers by means of the field effect transistors Q45, Q48, and Q50 to a common line. The force signal on this line is sampled by field effect transistors Q46 and Q49, the AND gating signal between the tuned percussion equality and strobe generated for sampling the digital-to-analog convertor output being used to gate these samples into the holding capacitors C28 and C31. A $\pi$ type RC, low-pass filter then filters the output to remove noise, the output potential being impedance buffered by voltage followers A31 and A33.

FIG. 32 displays the circuit for providing the signal indicating that the tone generators of the pair $\alpha$ are to be doubled whenever either member of the pair is sounded. The inputs to these circuits are provided by momentary pushbutton switches attached to latches, which connect the relevant line to an assertion potential when depressed. The decoders create signals indicating if pair $\alpha$ is on a particular clavier or if both pairs are on that clavier. The pair $\alpha$ signal on either clavier is ANDed with a doubling signal, if any, for each clavier to provide an ORed output indicating if the two members of each pair are to be doubled or not for that clavier. A similar circuit is used for pair $\beta$. A pair is doubled if it is on a particular clavier and the doubling signal is assertive.

FIG. 33 displays the circuit for generating the pair coupled signal. The same decoders are used as in FIG. 32, but this time they indicate if both pairs are on a common clavier. In addition to both pairs being on the same clavier, that clavier must be in the 4-notes-can-simultaneously-sound mode or the 2-notes-are-to-be-glissed mode. All these conditions must be present on one or the other claviers to produce an affirmative pair coupling control signal.

FIG. 34 is the circuit for generating the pair $\alpha$ read signals for each clavier. An assertion at an output results and the pair $\alpha$ is to be read if the pair $\alpha$ is present on the clavier that is to be read. An assertion at the read pair output results if the pair is present on any clavier that is to be read.

FIG. 35 is the circuit for generating the decoupling signal for the control units of the tuned percussion sound generators. The decoupling signal is OFF if either clavier A or clavier B has both blocks on it.

FIG. 36 is a circuit for generating nonpercussive sustain signals for the clavier C (pedals). If pair $\alpha$ is on the pedal clavier and if the sostenuto is ON, the sustain output is affirmative. SN1 when made affirmative turns ON the sostenuto; SN2 when made affirmative turns OFF the sostenuto. An identical circuit is used for the sostenuto for the percussive tone generators.

FIG. 37 is a circuit for generating the pair $\alpha$ glissando signal. Again, the same decoders are used as in FIG. 32, but presently they indicate whether or not pair $\alpha$ is on either clavier or whether both pairs are present on the same clavier. Pair $\alpha$ is glissed if it alone is present on a particular clavier and that clavier is in the one note glissed mode or if both pairs are present on a particular clavier and that clavier is either in the one note doubled and glissed mode or in the two note glissando mode.

Figure 38:
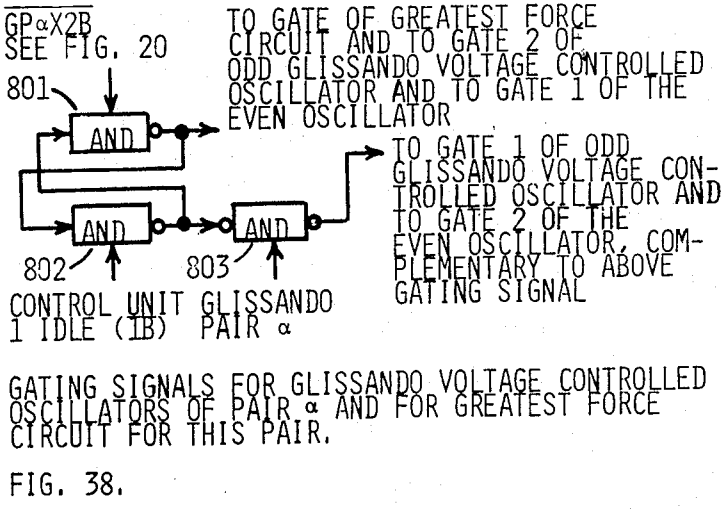
FIG. 38 is a logic diagram of the circuit that generates the gating signals for the glissando voltage-controlled oscillator of a particular pair and for the greatest force circuit associated with that pair.

FIG. 38 is a circuit for the gating signals for the glissando voltage-controlled oscillators of pair $\alpha$ and for the greatest force circuit for this pair. The idle signal applied to gate 802 is obtained from the negation output of the busy-idle flip flop 7 of FIG. 14, for example, for unit 1. The input to gate 801 is obtained from the output of gate 805 of FIG. 20. The following truth table 3 may be found helpful in understanding the operation of the circuit of FIG. 38. This figure is to be considered together, then, with FIGS. 14, 16, 20, 21, 24, and 25.

TABLE 3

Truth table for glissando oscillators and their controls.

| GLISSANDO | ODD CONTROL UNIT | EVEN CONTROL UNIT | GLISSANDO ODD | OSCILLATORS EVEN |
|---|---|---|---|---|
| OFF | BUSY | IDLE | ON | OFF |
| OFF | BUSY | BUSY | ON | OFF |
| OFF | IDLE | IDLE | ON/OFF | OFF/ON |
| OFF | IDLE | BUSY | ON/OFF | OFF/ON |
| ON | BUSY | IDLE | ON | OFF |
| ON | BUSY | BUSY | RUN | RUN |
| ON | IDLE | IDLE | ON/OFF | OFF/ON |

TABLE 3-continued

Truth table for glissando oscillators and their controls.

| GLISSANDO | ODD CONTROL UNIT | EVEN CONTROL UNIT | GLISSANDO ODD | OSCILLATORS EVEN |
|---|---|---|---|---|
| ON | IDLE | BUSY | OFF | ON |

The RS flip flop remembers the last state of the control units and glissando, and retains this last state of associations of notes and control units with the voltage-controlled oscillators. Thus, if the instrument is not in the glissando mode, then the odd glissando oscillator is always ON and the even glissando oscillator is always OFF. Thus, the glissando variable resistor always effectively connects the odd control unit to the odd voltage-controlled oscillator. The even glissando oscillator is always OFF.

Next, let us assume the glissando mode is ON. In this case, at the start of a glissando, the glissando oscillator associated with the control unit that is busy is ON and the other one is OFF. Upon depression of the second note, both control units become busy, both glissando oscillators go into the RUN mode, providing a potential at the output of the glissando variable resistor that is interpolated, according to the relative force with which the two notes are depressed, between the potentials appropriate to the voltage-controlled oscillators for the two notes. That glissando oscillator remains ON which is associated with the control unit busy with the note still remaining depressed after release of the other note, the control unit for which becomes idle and for which the associated glissando oscillator goes OFF. Upon release of the second note, the glissando oscillator that has been ON remains ON, even though both control units go idle, in order that decays take place at the frequency of the note finally depressed.

If the glissando is switched OFF when either both notes are released and the associated control units are idle or when the final note is still depressed and the associated control unit is still busy, the glissando oscillator that has been ON remains ON, again in order that the decay take place at the frequency of the note finally depressed. The memory of the state of the glissando oscillators is provided by the RS flip flop.

FIG. 39 is a logic diagram of a lockout that incorporates suppression inputs whereby the lockout signal for any individual control unit can be suppressed, thus preventing that control unit and its associated tone generators from going into the busy status. This mode is useful, particularly for instruments having only one keyboard, because it allows different tone colors to be associated with different notes that sound on the keyboard. As a result of the fixed priority, the order in which the control units are pressed into service is deterministic and known to the player. Thus, the first note depressed will exploit the first control unit, the second, the second one, and so on. Tone color A might be associated with the first control unit; tone color B with the second, tone color C with the third, and so on. If notes were always played with a key for tone color A being played first, that for tone color B second, and so on, there would be no need for the suppression inputs. However, tone color A may not be played before tone color B always. By suppressing the control unit for tone color A, tone color B can be made to sound first; then, by negating the suppression signal, tone color A can be made to sound second. And so on; by appropriate control of the suppression (or activation) signals through suitable keys or pedals, synchronously with the depression of keys or pedals controlling the sounding of tone generators, the various tone colors associated with the individual tone generators can be made to appear in any desired order.

By repeated use of De Morgan's theorem, it can be seen that: (1) Lockout 1 is high and, therefore, in the idle-ready status if and only if the first control unit is not suppressed and not busy. (2) Lockout 2 is high if and only if the second control unit is not suppressed and not busy, and the first lockout is OFF, i.e., low. (3) Lockout 3 is high if and only if it is not suppressed, nor busy, if neither lockout 1 or 2 is ON (high) and if the glissando for pair $\alpha$ is OFF. (4) Lockout 4 is high if and only if it is not suppressed, if control unit 4 is idle, if lockouts 1, 2, and 3 are all low and if the glissando for pair $\alpha$ is OFF.

Two gate signals are also shown for the purpose of controlling the glissing mode of the system. The output of gate 270 is high, i.e., ON, if pair $\alpha$ is not to be glissed and the second control unit is busy. The output of gate 272 is high if pair $\alpha$ is to be glissed and control unit 2 is busy or if control unit 1 is busy.

FIG. 40 is a block diagram of a sound generator suitable for creating the sound of a banjo. It is nearly identical with FIG. 23 of patent application Ser. No. 146,514, dated June 1, 1971, except that blocks merely providing a unity transfer of the input signal are replaced with a wire and blocks serving no useful function for the banjo are omitted. The following features are provided:

1. A decay time that decreases with increasing frequency of the fundamental of the note played.
2. An intensity that is determined by the maximum speed with which the note is depressed.
3. A sostenuto to sustain a note after it has been released and to stop the note after the sostenuto is itself released.
4. A spectral envelope that is approximately correct.
5. An attack transient that is short, but not so short the clicks or pops are produced in the sound.

The maximum speed with which a note is depressed is computed from the force signal 827, as discussed in connection with FIG. 24. The busy gate 55 provided by the control unit 108 is simultaneous with the depression of the note, and gates the sound, unless the sostenuto control line 825 of the musical instrument is activated. In this case, the sostenuto control 825 maintains the sounding of the tone. When the busy gate 55 and the sostenuto control 825 are both OFF, the note decays away within about 3 cycles after the note is released. It cannot be revived solely by a reactivation of the sostenuto control 825 because the busy gate is absent when the note is released, the peak speed signal is, thus, zero, and the potential across the capacitor 510, to which the amplitude of the envelope is proportional, is zero. To these ends, the busy gate 55 and the sostenuto-control signal 825 are NORed together by gate 501. The output of this NOR gate and the ungated variable frequency pulses are NORed together by gate 505. If both the sostenuto and busy gate are low (negation), the NOR gate 505 drains the capacitor 510 completely, thus creating an envelope of zero amplitude, regardless of the momentary state of the ungated frequency pulses. If either the sostenuto or busy gate are high (assertions), the NOR gate 505 drains the capacitor 510 only when the ungated frequency pulses are (momentarily) high and ceases to drain this capacitor 510 when the ungated frequency pulses are (momentarily) low, as the gated impedance drain is designed here. (It could have been designed to function in just the opposite way in which case the NOR gate 505 would be replaced by an OR gate.) The gated impedance drain 508 and the NOR gate 505 may consist of merely a transistor with a resistor in its collector attached to the capacitor 510, to limit the rate of discharge of this capacitor, and with its emitter connected to ground. The output of the NOR gate 501 may be connected to the anode of a diode, the cathode of this diode may be connected to the base of the transistor in the NOR gate 505. The ungated variable frequency pulses may be applied to another resistor connected to the base of this transistor, together with a suitable biasing resistor, thus forming a NOR gate (positive logic).

The storage capacitor 510 is charged up through a diode 511 in each decay generator. This diode is driven by the output of a controlled limiter 515. In those cases where the auto repeat feature is omitted and no percussion drive signal is provided from a suitable source, such as an astable multivibrator, the function of this diode 511 and the controlled limiter 515 is served merely by a transistor the base of which is capacitively coupled to the peak speed signal 826 and a suitable biasing resistor, the emitter of which is connected to a suitable resistor the other side of which resistor is connected to the gated impedance drain 508 and the capacitor 510, and the collector of which is connected to a suitable supply potential.

Thus, with variable frequency excitation of the gated drain 508, the higher the frequency of the note, the more frequently charge is drained from the capacitor 510, which stores a charge proportional to the output 826 of the peak detector shown in FIG. 24, and the faster the capacitor 510 potential decays. The ungated frequency pulses are obtained from FIG. 23 or FIG. 31.

A low-pass filter 514 in the output of the decay generator tempers the attack of the notes produced by the potential of the capacitor 510 just enough to remove any click or pop associated with the start of the note. A time constant of 5 msec usually suffices for this purpose.

The ungated variable frequency pulses 460 are applied directly to the amplitude modulator 517 in the case of the banjo, the prefilters and phase modulators of the aforementioned application being merely unity transfer functions in this case. The amplitude modulator 517 is preferably a balanced amplitude modulator with two inputs, one for the modulating signal and one for the modulated signal. The variable frequency pulses are applied to the modulated signal input of the balanced modulator; the output 519 of the decay generator is applied to the modulating signal input.

The output of the modulator 517 is applied to a spectral envelope shaper 518. This may be a normal formant filter. In the case of the banjo, this formant filter consists of a bandpass filter centered at 800 Hz with a 3 dB bandwidth of 600 Hz. An active filter having unity gain was used comprised of resistors, capacitors, and transistors, as shown in FIG. 27. (The design methodology is described in such places as EDN, p. 43 ff (Jan. 15, 1970).)

As with nonpercussive soundgenerators, the ungated frequency pulse 460 may be used to produce a decay transient after the coacting note is released, and is available until the control unit is associated with a new note.

I claim:

1. Sound generating apparatus comprising, output means, a plurality of sound generators coupled to said output means for providing note signals with each including means for producing any of a large common plurality of frequencies characterizing respective musical notes over at least an octave, a plurality of note selecting means for selecting note signals characteristic of selected notes for production by said sound generators where each note selecting means includes means upon selection for providing a note selection signal representing a unique contribution to a signal waveform on said output means which note signal is representative of at least one of note pitch, speed of note selection and force applied to note selecting means, control means coupled to said sound generators for providing continuous data signals to said sound generators representative of the selected note signals for selecting which of said sound generators coupled to said output means is to provide said note signals, scanning means for interrogating said note selecting means to couple the selected note selection signals to said control means, wherein each of said sound generators includes means for varying the frequencies thereof and may be associated with any note and includes means for generating the frequencies of notes at least a semitone apart and said control means includes means for associating different ones of said sound generators with each note selected by said note selecting means for controlling the frequency of an associated tone generator in accordance with that of the associated note, said control means including fixed priority establishing means for assigning a hierarchy of priorities to said sound generators independent of the history of selection of sound generators whereby the idle sound generator with highest priority among those then idle is selected for association with the next note to be selected, said fixed priority establishing means including means responsive to the most recent association of a sound generator with a note for providing, prior to selection of the next note by said note selecting means, a logical signal designating the particular sound generator to be associated with said next note.

2. Sound generating apparatus in accordance with claim 1 wherein said control means includes means for storing the address of the last note a particular sound generator was associated with and said priority establishing means includes means responsive to the stored note address signals for associating a sound generator most recently associated with a particular note with that note when said note selecting means again selects it.

3. Sound generating apparatus in accordance with claim 1 and further comprising, means for providing a duration signal representative of the time a particular sound generator has been associated with a particular note, and said priority establishing means includes means responsive to said duration signals for selecting that one of the sound generators still associated with particular notes which has been associated with its particular note for the longest time for disassociation from the latter particular note and association with the most recently selected note signal when all of said sound generators are associated with particular notes.

4. Sound generating apparatus in accordance with claim 1 wherein said priority establishing means includes means for a player actuating said note selecting means to change the order in which particular sound generators are selected for association with a temporal sequence of notes.

5. Sound generating apparatus in accordance with claim 1 wherein said priority establishing means includes means for intercoupling a plurality of control units each associated with a respective one of said sound generators to form a priority hierarchy of all said control units.

6. Sound generating apparatus in accordance with claim 1 wherein each of said note selecting means comprises a key that is movable up and down and side-to-side and further comprising, means responsive to said up and down movement for providing a note address signal designating a particular nominal center frequency for an associated tone generator, and means responsive to said side-to-side movement for correspondingly varying the frequency of said associated tone generator.

7. Sound generating apparatus in accordance with claim 6 wherein said means responsive to the side-to-side movement comprises a capacitor divider circuit associated with each key comprising first and second capacitors having a common first plate and respectively first and second plates with each second plate comprising one finger of two fingers both of which are actuated by depression of the associated key, a frequency modulation transistor having at least control, input and output electrodes with the control electrode connected to said common plate and output electrode coupled to the output electrodes of the other frequency modulation transistors associated with the other keys to comprise an OR circuit, whereby the side-to-side movement produces a corresponding variation in the difference between the capacitance of said first and second capacitors.

8. Sound generating apparatus in accordance with claim 7 and further comprising a source of first and second coincident pulse trains of opposite polarity, means for coupling the first train and second train pulses to said first and second fingers respectively to produce difference pulses on said common plate monotonically related to the side-to-side displacement, and means responsive to said difference pulses for controlling variations in the frequency of the associated sound generator.

9. Sound generating apparatus in accordance with claim 1 wherein said sound generator comprises a sawtooth, integration type of voltage controlled oscillator including an integrator and an integrating-capacitor, capacitor-charge dumping gate and a resistor coupled between the output of said integrator and said integrating-capacitor-capacitor-charge dumping gate for exactly compensating the reset time of the integrator to establish a linear relationship between an input frequency controlling potential and output frequency over at least an octave.

10. Sound generating apparatus in accordance with claim 9 wherein a source of said input frequency controlling potential includes first and second cascaded operational amplifiers for receiving first and second frequency controlling potentials respectively and a substantially constant reference potential, a source of said substantially constant reference potential, a source of a supply potential coupled to said operational amplifiers, and means for intercoupling said first and second operational amplifiers so that said input frequency controlling potential depends only on the offset characteristics of said operational amplifiers, said frequency controlling potentials and resistance ratios independently of said supply potential.

11. Sound generating apparatus in accordance with claim 6 and further comprising, means responsive to depression of a key for initially preventing side-to-side position of said key from affecting the frequency of the associated sound generator, whereby the frequency of the associated tone generator immediately following depression of a key corresponds to said nominal center frequency.

12. Sound generating apparatus in accordance with claim 1 and further comprising, glissando control circuits including means for associating first and second control units with first and second note selecting means establishing the frequency limits of a predetermined glissando, means for storing an indication of which note selecting means of the pair involved in the glissando was released last, and means for providing continuing access of the frequency-determining signal for the sound generator associated therewith so that each time that note selecting means is scanned the associated frequency determining signal is available to the sound generator associated therewith even though the note selecting means is then released.

13. Sound generating apparatus in accordance with claim 12 wherein said first and second control units are associated with a common voltage controlled oscillator comprising a sound generator and said note selecting means comprises a clavier having keys associated with respective musical notes and further comprising, means for associating a first of said keys when depressed with said first control unit and a second of said keys when depressed after said first key is depressed with said second control unit to provide a time varying frequency controlling potential, and means for coupling said time varying frequency controlling potential to said common voltage controlled oscillator to correspondingly control the frequency thereof that gradually changes between said frequency limits.

14. Sound generating apparatus in accordance with claim 1, wherein said note selecting means comprises keys and further comprising, means for providing a signal representative of the peak speed attained by an actuated key comprising, means for providing a force signal representative of the force applied to the key, differentiating means responsive to said force signal for providing a signal representative of key speed, a closed loop comprising an operational amplifier coupled to a peak detector circuit including a diode that delivers a peak signal coupled to the output of said differentiator functioning as a reset circuit for resetting the peak detector circuit to a condition for accepting a new peak signal and for providing a speed signal representative of the maximum speed achieved by the actuated key.

15. Sound generating apparatus in accordance with claim 1 wherein said note selecting means comprises a plurality of claviers and further comprising means for associating a pair of control units comprising said control means with a corresponding pair of keys in one clavier to establish a glissando beginning at the tone determined by one key and ending at the tone determined by the other key, and means for transferring said pair of control units to another pair of keys in another clavier.

16. Sound generating apparatus in accordance with claim 1 wherein said control means comprises, note address storage means for storing the address of a note then associated with said control means, a note address input for receiving a note address signal representative of a particular note then selected by said note selecting means and then scanned by said means for scanning, means for comparing the signal on said note address input with the signal in said note address storage means for providing a compare signal upon identity, a busy/idle bistable element for providing an idle signal when ready to accept association with a selected note, means including a startup bistable element responsive to the occurrence of a startup signal and said identity signal for terminating said idel signal, a source of a reset signal, and means for coupling said reset signal to said busy/idle bistable element to cause said busy/idle bistable element to provide said idle signal, said note address storage means being responsive to said startup signal for accepting an address signal then on said address input for storage therein.

17. Sound generating apparatus in accordance with claim 16 wherein said means including a startup bistable element includes delay means responsive to the signal provided by said startup bistable element for furnishing a delayed signal to said busy/idle element for terminating said idle signal and responsive to said reset signal for providing said idle signal.

18. Sound generating apparatus in accordance with claim 1 wherein said note selecting means includes a key that comprises conductive sponge material insulatedly separated from a conductive plate to comprise a variable capacitor while also providing a restoring force to the key to restore the key to the nonselecting condition upon removal of an actuating force therefrom.

19. Sound generating apparatus in accordance with claim 1 wherein a sound generator for creating the sound of a banjo comprises, a source of ungated variable frequency pulses, a source of a peak speed signal representative of the maximum speed with which a note selecting means is actuated, a source of a sostenuto signal for sustaining a note after a note selecting means selecting it has been released, amplitude modulating means having a signal input coupled to said source of ungated variable frequency pulses and a modulating input for receiving a modulating signal for modulating said ungated variable frequency pulses to provide a modulated signal having an envelope characterized by a decay time that decreases with increasing frequency of the fundamental of the note then selected and an intensity related to said peak signal, means coupled to said source of ungated variable frequency pulses for providing a frequency signal representative of the frequency of said ungated variable frequency pulses, means for combining said peak speed signal with said frequency signal to provide a modulating signal coupled to said modulating input, and spectral envelope filtering means coupled to the output of said amplitude modulating means for shaping the spectrum of the modulated signal provided by said amplitude modulating means to conform substantially to that of the spectrum of the selected banjo note.

20. Sound generating apparatus in accordance with claim 19 and further comprising low-pass filtering means energized by said modulated signal having an envelope characterized by a decay time for removing audible clicks or pops associated with the start of a note.

21. Sound generating apparatus in accordance with claim 19 wherein said spectral envelope filtering means comprises a band pass filter having a center frequency of substantially 800 Hz and a band width between 3 dB down points of substantially 600 Hz.

22. Sound generating apparatus in accordance with claim 15 and further comprising means for establishing a control mode in which selection of a note by said note selecting means causes activation of a specific number of control units, said means for establishing including a startup signal from a control unit as a startup signal for other associated ones of said control units.

23. Sound generating apparatus in accordance with claim 17 and further comprising a source of an inhibit signal for preventing the occurrence of a startup signal, and means responsive to a predetermined condition for providing said inhibit signal to prevent the control unit associated therewith from being associated with any selected note whereby those control units not then receiving inhibit signals may be associated with a sequence of selected notes.

24. Sound generating apparatus in accordance with claim 1 wherein a sound generator for simulating french horn tones comprises, a source of ungated pitch pulses, a source of gating signals, a source of the force signal representative of the force with which a note is selected, gating means responsive to said gating signals for coupling said ungated pitch pulses to the gating means output to provide gated pitch pulses, a burple generator comprising a filter coupled to said source of a force signal having a resonant frequency of substantially 50 Hz with a Q of substantially 5 for producing pulse width modulation of the gated pitch pulses, a source of an envelope function signal, modulating means coupled to said source of said envelope function signal, said burple generator and said force signal for modulating the width of said gated pitch pulses in accordance with said force signal and the output of said burple generator and the height in accordance with said envelope function, and formant filtering means having a resonance of the order of 450 Hz, and means for coupling the width-height modulated signal to said formant filter.

25. Sound generating apparatus in accordance ith claim 24 wherein said source of ungated pitch pulses comprises, an initial source of ungated pitch pulses, multiplexing means coupled to said source of initial ungated pitch pulses, a source of transposition signals, counting means coupled to said source of initial ungated pitch pulses and responsive to said initial ungated pitch pulses for providing multiplex control signals, said multiplexer being coupled to said counting means and said source of transposition signals and responsive to them for providing said ungated pitch pulses at a rate that is equal to or a submultiple of the rate of said initial ungated pitch pulses.

26. Sound generating apparatus in accordance with claim 21 and further comprising, first means for amplifying the width-height modulated signal at loud, soft and moderate levels in response to soft and loud control signals, the presence of said soft control signal and said loud control signals producing soft and loud amplification respectively, the absence of said soft and loud control signals producing moderate amplification.

27. Sound generating apparatus in accordance with claim 1 wherein said control means includes a lockout circuit means for providing inhibit signals for preventing control units associated with respective sound generators from being associated with a duly selected note comprising, a ready input for receiving a ready signal representative of selection of a new note for association with a sound generator, input lines for receiving signals representative of the busy and idle states of the control units, and means responsive to the presence of said ready signal, busy signals from the control units of lesser order than a given control unit and an idle signal from said given control unit for inhibiting an inhibit signal to said given control unit while providing inhibit signals to said control units of lesser order.

28. Sound generating apparatus in accordance with claim 1 wherein said control means includes a first group of control units and a second group of control units and lockout circuit means for preventing each of said control units from being associated with a newly selected note except upon the occurrence of the following conditions:

the occurrence of a ready signal indicating a note has been selected by said note selecting means for association with a control unit, a respective control unit is in the idle condition, all control units of order number lower than a respective control unit in the group are busy and either the group comprising the respective control unit is not then coupled to another group or all the control units of said another group coupled to the first mentioned group are then busy.

29. Sound generating apparatus in accordance with claim 1 and further comprising means for selecting which of two continuous note selection signals is the larger comprising, first and second emitter followers, means for applying said first and second note selection signals to the bases of said first and second emitter followers respectively, a field effect transistor having its source coupled to the emitter of one of said emitter followers and its drain coupled to the emitter of the other of said emitter followers, and means for coupling a gating signal to the gate of said field effect transistor for selectively rendering said field effect transistor conductive to effectively then intercouple the emitters of said first and second emitter followers and provide an output signal on the then intercoupled emitters representative of the greater of the two signals applied to the respective bases of said emitter follower.

30. Sound generating apparatus in accordance with claim 1 and further comprising sample and hold gates for storing said note selection signals associated with respective claviers of a plurality thereof comprising said note selecting means with the output of each sample and hold gate being connected to sample and hold circuit means, means for enabling a respective sample and hold gate in response to selection of the associated note by the note selecting means and readiness of an associated control means for providing a note selection signal to said sample and hold circuit means for controlling the character of a note signal provided by an associated sound generator.

31. Sound generating apparatus in accordance with claim 30 wherein said note selection signal is representative of force.

32. Sound generating apparatus in accordance with claim 30 wherein said note selection signal is representative of side-to-side motion imparted to a clavier.

33. Sound generating apparatus in accordance with claim 1 wherein at least one sound generator includes a glissando voltage controlled oscillator comprising, capacitive means for storing a charge, first switching means for discharging said capacitive means, a current source having a control electrode for providing a current proportional to a signal applied on said control electrode for delivering charging current to said capacitive means, bistable circuit means for selectively providing an output signal representative of the potential across said capacitive means, said bistable circuit including a gating input for receiving a signal for selectively enabling and disabling said bistable circuit.

34. Sound generating apparatus in accordance with claim 1 wherein a sound generator includes a run-up circuit comprising, first gated circuit means having a time constant of substantially 1 second, second gated circuit means having a time constant of substantially 1 microsecond, and summing junction means for cumulative combining the outputs of said first and second gated circuit means coupled to said first and second circuit means.

35. Sound generating apparatus in accordance with claim 34 wherein said first gated circuit means comprises a first resistor in series with a first capacitor with the junction of said first resistor and first capacitor providing a run-up output, said second gated circuit means comprises a second resistor in series with a second capacitor with the junction therebetween being for receiving an input signal for processing by said run-up circuit means, first and second transistors having their emitters interconnected to the junction between a third resistor and said first capacitor and the base of said first transistor connected to the junction of said second resistor and second capacitor, and means for coupling a gating signal to the base of said second transistor.

36. Sound generating apparatus in accordance with claim 1 wherein said control means includes lockout intercoupling circuit means comprising, an n-flop having n bistable stages characterized by n stable states and having n inputs, n run-up circuit means coupled to respective ones of said n-flop inputs for providing run-up signals thereto, each of said run-up circuit means having a first input for receiving a busy signal from an associated control unit in said control means and a second input connected to the other second inputs for receiving a common gating signal, means for providing separate outputs from each of said n bistable stages for providing separate lockout signals, and or gate means for combining the outputs of each of said n bistable stages for providing a lockout intercoupling signal.

37. Sound generating apparatus in accordance with claim 1 wherein a sound generator includes a voltage controlled oscillator having a frequency controlling input and said control means includes a control unit associated with each voltage controlled oscillator having sample and hold circuit means responsive to a note selection signal for providing a frequency controlling signal to the frequency controlling input of an associated voltage controlled oscillator, each control unit including means for storing the address in said note selecting means of the last note with which it is associated, means for comparing the stored address with that of the note then being interrogated by said means for scanning, and means for providing busy and idle signals representative of the associated voltage controlled oscillator being not free and free respectively to become associated with the note then being interrogated by said scanning means.

38. Sound generating apparatus in accordance with claim 1 wherein said control means comprises a control unit associated with each of said sound generators, each control unit having means for storing the address of the note with which it is or last was associated, means for providing busy and idle signals respectively representative of it being and not being associated with a note then selected by said note selecting means, said control means further including demand circuit means associated with all said control units for providing a demand signal indicating if any control unit is not then associated with a note then being interrogated to provide a demand signal for associating an idle control unit with the note then being interrogated when that note is also selected by said note selecting means.

39. Sound generating apparatus in accordance with claim 38 wherein said demand circuit means provides no demand signal when a control unit storing the address of the note then being interrogated also provides a busy signal.

40. Sound generating apparatus in accordance with claim 39 wherein said demand circuit means comprises AND gates grouped in pairs with each gate in a pair including a control-unit buty input and a control-unit equality input and a first gate in each pair including a pair read input, an OR gate for each pair having input legs connected to respective outputs of each gate in a pair for providing an output signal that is the demand signal for the associated control units.

41. Sound generating apparatus in accordance with claim 40 and further comprising, a middle OR gate having a pair of inputs respectively coupled to the outputs of said first-mentioned OR gates, an output AND gate having a first input coupled to the output of said middle OR gate and a second input for receiving a pair coupling control signal, and upper and lower OR gates each having one input leg coupled to the output of said output AND gate and the other input leg coupled to a respective one of the outputs of said first-mentioned OR gates for providing demand signal for an associated pair of control units.

42. Sound generating apparatus in accordance with claim 1 wherein said scanning means comprises, clock means for providing driving clock pulses, note counter means driven by said clock pulses for providing elements of note address signals, octave counter means driven by said note counter means for providing other elements in note address signals, decoding means having a plurality of inputs connected to respective outputs of said note counter means and said octave counter means for providing a signal representative of a designated note address to then be interrogated, digital-to-analog converting means responsive to a signal provided by said decoding means for providing a corresponding potential representative of the freuqency of a note of a note of a musical scale designated by the note address signal, a note strobe univibrator triggered by said clock pulses for providing a note strobe signal, said control means including a plurality of control units each associated with a respective sound generator for providing an equality signal when the associated tone generator is then associated with a note designated by the contemporary address signal, a note depressed detector for providing a signal representative of a note having been selected by said note selecting means, a read univibrator triggered by the occurence of an equality signal or a signal provided by said note depressed detector, and an AND gate having a first of its two inputs coupled to the output of said note strobe univibrator and the other of its inputs coupled to the output of said read univibrator and having its outputs coupled to said decoding means for providing a gating signal that then causes said decoding means to provide the decoded output signal representative of the pitch of a note signal to then be provided.

43. Sound generating apparatus in accordance with claim 1 wherein said note selecting means comprises a keyboard having a transistor associated with each note and a pair of capacitors associated with each transistor connected together at a junction connected to the associated transistor base, a frequency modulation strobe univibrator coupled to and for providing a pair of equal and opposite frequency modulation interrogating pulses to said keyboard, means for coupling respective ones of said frequency modulating interrogating pulses to respective free ends of said first and second capacitors, means for coupling the emitters of all said transistors to a common line, and frequency modulation decoder means coupled to said common line for providing a frequency modulating signal representative of the unbalance between the signals transmitted through the first and second capacitors.

44. Sound generating apparatus in accordance with claim 1 wherein said scanning means comprises, a gated clock for providing clock pulses, a note depressed detector for providing a note depressed signal representative of a note being selected by said note selecting means, said control means including a control unit for each of said sound generators each having means for providing an equality signal representative of the associated tone generator being associated with the note then being interrogated by said scanning means, a read univibrator triggered by a signal provided by said note depressed detector or said equality signal for providing a read signal, and means for coupling said read signal to said gated clock to prevent said gated clock from cycling until the output signal provided by said read univibrator ends.

45. Sound generating apparatus in accordance with claim 1 wherein said scanning means includes, gated clock means for providing clock pulses, a note depressed detector for providing a signal representative of a note having been selected by said note selecting means, said control means including a control unit associated with each of said sound generators including means for providing an equality signal when the associated sound generator is then associated with a note then being interrogated by said scanning means, a read univibrator triggered by a signal provided by said note depressed detector or by said equality signal for providing a read signal, and an AND gate having a first of two inputs coupled to the output of said note depressed detector and the other of its inputs coupled to the output of said read univibrator for providing a gated read signal to said control units, and a reset univibrator triggered by the output signal provided by said read univibrator.

46. Sound generating apparatus in accordance with claim 1 wherein said scanning means comprises, gated clock means for providing clock pulses, a note depressed detector coupled to said note selecting means for providing a signal representative of a note being selected, a force decoder having first and second inputs for providing as an output a signal proportional to the time delay between the two signals applied to said first and second inputs, means for coupling the output of said note depressed detector to one of said inputs, and means for coupling the output of said gated clock means to the other of the force decoder inputs.

47. Sound generating apparatus in accordance with claim 1 wherein said control means includes a plurality of control units each associated with a respective one of said sound generators and said priority establishing means includes means for intercoupling a plurality of control units to form a priority hierarchy of all said control units, said priority establishing means including, means for providing a higher priority signal H that is zero when all control units of higher priority are busy, means for providing a block inhibited signal BI that is one when all control units are busy for then inhibiting scanning by said scanning means until a control unit is not busy, means for providing a block coupled signal BC that is zero when the block of associated control units is coupled to another block of control units, and means for providing a lockout signal $L_i$ that is one when the associated control unit is selected, and logical circuit means for providing the system lockout signal satisfied by the logical relationship $(L_i \times BC + \overline{H} \times \overline{BI})$ as a system lockout signal and logical circuit means for providing a lower priority signal $H = \overline{BC} \times \overline{BI} \times \Sigma_i L_i$ to effectively cascade lockouts.

48. Sound generating apparatus in accordance with claim 1 wherein said control means includes a control unit associated with each sound generator and means for providing a busy signal indicative of the associated sound generator and control unit then being associated with a particular note, a source of a manually controlled suppress signal for a control unit for keeping that control unit and the associated sound generator associated with a particular note, logical circuit means responsive to the absence of a first suppress signal and a first busy signal each associated with a first control unit for providing a first lockout signal, logical circuit means responsive to the absence of a second suppress signal and a second busy signal associated with a second control unit and the absence of said first lockout signal for providing a second lockout signal.

49. Sound generating apparatus in accordance with claim 48 and further comprising a source of a glissando control signal, and logical circuit means associated with each control unit for providing a lockout signal in the absence of an asociated suppress signal, an associated busy signal, a lockout signal associated with a control unit of lower order number and said glissando control signal.

50. A sound generator for creating the sound of a banjo comprising, note selecting means for selecting sound to be generated, a source of a peak speed signal representative of the maximum speed with which a note selecting means is actuated, a source of a sostenuto signal for sustaining a sound after a note selecting means selecting it has been released, a source of ungated variable frequency pulses, decay generating means coupled to said source of ungated variable frequency pulses, said source of a sostenuto signal, and said source of a peak speed signal for providing a modulating signal of amplitude characterized by a decay time that decreases with increasing frequency of said ungated variable frequency pulses and intensity related to said peak speed signal, amplitude modulating means having a signal input coupled to said source of ungated variable frequency pulses and a modulating input for receiving said modulating signal for modulating said ungated variable frequency pulses to provide a modulated signal having an envelope characterized by a decay time that decreases with increasing frequency of the fundamental of the sound then selected and an intensity related to said peak speed signal, and spectral envelope filtering means coupled to the output of said amplitude modulating means for shaping the spectrum of the modulated signal provided by said amplitude modulating means to conform substantially to that of the spectrum of the selected banjo sound and comprising a bandpass filter centered at substantially 800 Hz with a 3 db bandwidth of substantially 600 Hz.

51. A sound generator for simulating French horn tones comprising, note selecting means for selecting sounds to be generated, a source of ungated pitch pulses, a source of gating signals, a source of a force signal representative of the force with which a sound is selected, gating means responsive to said gating signals for coupling said ungated pitch pulses to the gating means output to provide gated pitch pulses, a burple generator comprising a filter coupled to said source of a force signal having a resonant frequency of substantially 50 Hz with a Q of substantially 5 for producing pulse width modulation at a modulating rate of less than 10 Hz of the gated pitch pulses, a source of an envelope function signal, modulating means coupled to said source of said envelope function signal, said burple generator and said force signal for modulating the width of said gated pitch pulses in accordance with said force signal and the output of said burple generator and the height in accordance with said envelope function to provide a width-height modulated signal, formant filtering means having a resonance of the order of 450 Hz, and means for coupling the width-height modulated signal to said formant filter.

52. In a music synthesizer comprised of a keyboard of M keys and a plurality of N voice channels, where $N<M$, each voice channels being responsive to a control voltage and a gate signal applied thereto for producing a sound whose frequency and duration are determined respectively by said control voltage and gate signal, the improvement comprising a control system for monitoring the states of said keys to produce, with respect to each closed key, a control voltage and gate signal for application to one of said voice channels, said control system comprising:

counter means for cyclically producing a series of M unique addresses, each address identifying a different one of said M keys;

means responsive to each of said M addresses for sampling the state of the identified key to produce a data signal comprised of successive bit signals, each at a first or second level respectively indicative of an open or closed key state;

N channel logic means each connected to a different one of said channel logic means including register means capable of storing a key address;

channel selection means responsive to said data signal produced by said sampling means defining said second level indicative of a closed key state for storing the address identifying that key is one of said N channel logic means registers;

means in each of said N channel logic means for producing a gate signal with respect to the key identified by the address stored therein representing the time duration that the key remains in said closed state; and means in each of said N channel logic means for producing a control voltage having a level related to the address therein, digital to analog converter means responsive to said counter means for producing an analog voltage having a level related to the address produced by said counter means; and means for applying said analog voltage to each of said channel logic means, wherein each of said channel logic means includes a compare means for producing a match signal responsive to said address produced by said counter means matching the address stored in the register thereof, means for selectively defining either a REASSIGN or NON-REASSIGN mode; and means operative in said NON-REASSIGN mode and responsive to the production of said match signal for preventing said channel selection means from storing said address.

* * * * *